United States Patent [19]

Moen

[11] Patent Number: 4,581,005

[45] Date of Patent: Apr. 8, 1986

[54] MANUFACTURE OF BOXES WITH INTEGRALLY REINFORCED WALLS

[76] Inventor: Lenard E. Moen, 7914 Michigan, Whittier, Calif. 90602

[21] Appl. No.: 636,917

[22] Filed: Aug. 2, 1984

Related U.S. Application Data

[63] Continuation-in-part of Ser. No. 499,988, Jun. 1, 1983.

[51] Int. Cl.[4] ..... B31B 3/02; B65H 9/10

[52] U.S. Cl. ..... 493/167; 493/89; 493/143; 493/180; 271/233; 271/269

[58] Field of Search ..... 493/167, 143, 89, 90, 493/122, 180, 175, 176, 178, 417, 912, 127, 126; 271/233, 235, 269

[56] References Cited

U.S. PATENT DOCUMENTS

| | | | |
|---|---|---|---|
| 1,780,049 | 10/1930 | Troyer | 271/269 |
| 1,986,857 | 1/1935 | Roberts et al. | 271/233 |
| 2,565,054 | 8/1951 | Watrous | 271/269 |
| 2,872,189 | 2/1959 | Robinson | 271/269 |
| 3,311,370 | 3/1967 | Hunter | 271/84 |
| 3,390,790 | 7/1968 | Atkins et al. | 271/269 |
| 3,673,928 | 7/1972 | Striplin | 493/167 |
| 4,095,554 | 6/1978 | Moen | 118/711 |
| 4,315,752 | 2/1982 | Moen | 493/171 |
| 4,341,299 | 7/1982 | Walker et al. | 198/434 |

*Primary Examiner*—Lowell A. Larson
*Assistant Examiner*—William E. Terrell
*Attorney, Agent, or Firm*—Frederick E. Mueller

[57] ABSTRACT

Various configurations of boxes of a corrugated or fiberboard material are manufactured by a machine and process in which scored marginal flaps of the preformed box blank material are laterally wrapped around forming mandrels of fingers to define corner and/or intermediate posts integral with a wall portion of the resulting box, with at least a portion of each flap laminated to the side wall.

6 Claims, 70 Drawing Figures

MANUFACTURE OF BOXES WITH INTEGRALLY REINFORCED WALLS

CROSS REFERENCE TO RELATED APPLICATION

This application is a continuation-in-part of my copending application, Ser. No. 499,988, filed June 1, 1983, for manufacture of boxes with integral hollow wall posts and laminator tabs.

BACKGROUND OF THE INVENTION

The present invention relates to the manufacture of containers or boxes made of corrugated or the like material. More particularly, the invention relates to an improved container geometry incorporating integrally formed corner and/or intermediate posts and a single cycle method and machine for making such containers.

It has long been recognized that the stacking strength of containers made of corrugated material is significantly increased by inserting posts into the container. In the past it has been common practice to separately fabricate such posts which are then inserted into a preformed box. Preformed corner posts or the like are shown in the following U.S. patents: Brown, U.S. Pat. Nos. 3,734,389; Goodsite, 3,613,985; Svendsen, 3,072,313; Fremion, 3,982,682; Stump, 3,648,920. The prior art also discloses various forms of collapsed containers made of complex blanks of corrugated or paperboard material which are erectable into packages or containers which have posts integral with the corner portions thereof. Examples of such containers are shown in the following U.S. patents: Rudofski, U.S. Pat. Nos. 3,162,351; Adams, 3,397,831; Sieffert, 3,861,580; Kullman, Jr., 4,068,796; and Forrer, 3,034,698. However, insofar as I am aware, it is unknown in the prior art to machine-form either a single piece or a multiple piece erected container in a single cycle of operation in a manner to provide corner and/or intermediate posts integral with a side wall portion of the resulting container, the resulting side wall also having a laminated portion.

SUMMARY OF THE INVENTION

The invention provides a machine made reinforced wall container having corner and/or intermediate posts comprising integral portions of the same piece of material constituting an end panel or side wall of the box.

The process of the invention utilizes preformed flat blanks of paperboard material. In each case, the rectangular area of the material out of which the reinforced end panel will be made has a first scoreline, defining a junction between a central wall area and each marginal flap of the material, while the flap itself is formed with a plurality of scorelines defining at least three portions of the flap. First, each flap is turned bodily in the direction of the outside face of a mandrel or flat finger about the first scoreline and towards a surface of the wall area. Then, while continuing folding of second and third portions of the flap, the flap is bent around an apex of the mandrel or finger about the second scoreline. Thereafter, while continuing bodily folding of the second and third portions of the flap, the flap is bent about the third scoreline in a manner to bend the third portion towards parallelism with the surface of the wall area onto which it is subsequently laminated. In one of the alternative embodiments of the invention, where the flap is formed with fourth, fifth and sixth portions, certain of the above sequence of steps are repeated on a second mandrel to form an intermediate reinforcing post and second laminator tab.

The machine of the invention comprises a framework fitted with a hopper and material feed station, a post forming and laminating station immediately downstream therefrom and, in some cases, a finished end panel erector station. In the forming station, the machine has an array of mandrels about which the flaps of the blanks of material to be worked on are folded. Flap folding mechanisms are mounted on each side of the machine, each such mechanism being positioned in operative opposition to a corresponding mandrel or mandrels. In some embodiments, the mandrels are positioned above the material support rails or shoes while the flap folding mechanisms are supported beneath the support rails. However, in an embodiment for forming H-divider boxes, the positions of the mandrels and flap folding mechanism with respect to the support rails for the box material blanks are reversed or inverted.

The machine incorporates a shuttle mechanism fitted with two longitudinally spaced sets of blades, an outer pair of which transport a flat unworked blank out of the hopper station, past glue guns and into indexed operative relationship to the mandrels and flap folding mechanisms. In one embodiment, subsequent reciprocation of the shuttle mechanism moves a formed end panel past the mandrels by means of the second pair of shuttle blades while the first or outer pair of shuttle blades delivers a new unformed blank into position.

Each flap folding and laminating mechanism includes a base frame oscillatable on an axis parallel to the corresponding mandrel. At the outer swingable end of the base frame another frame, at an inwardly projecting end thereof, supports a platen. The base frame and second frame comprise portions of a parallelogram linkage system that includes a link of variable length, as by extension and retraction of a piston rod, so that the platen is transported in a non-linear path in a mode to effect wrapping of the flap portions around the mandrel and pressing of the laminator tab into laminar relationship with a pre-glued part of the central wall area of the panel. In an alternative embodiment, wherein it is desired to form an interior reinforcing post and laminator tab, an additional frame is mounted at the upper or outer end of the base frame, with its own variable parallelogram linkage system and operable in phased relation to the first frame. In another embodiment, the mechanism has a trunnion carrying a powered rack and pinion for swinging the platen through the desired trajectory and a pressure plate against which the platen reacts. The invention also comprises a means adapting the machine to handle a wide range of sizes of the flat sheet material to be processed.

DESCRIPTION OF THE PREFERRED EMBODIMENT

Figure 2:
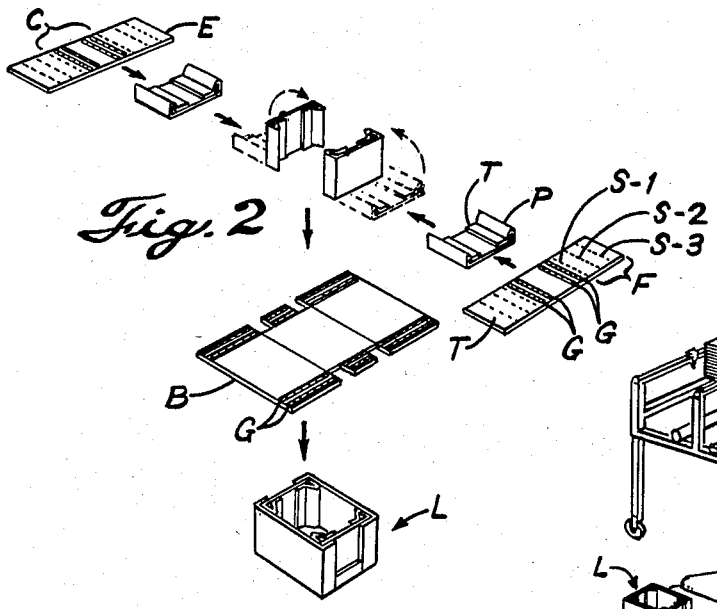
FIG. 2 is a flow diagram illustrating the process of making containers.

Before explaining the invention in detail, it is to be understood that the invention is not limited in its application to the details of construction and the arrangements of components set forth in the description or illustrated in the drawings. The invention is capable of other embodiments and of being practiced and carried out in various ways. Also, it is to be understood that the phraseology and terminology employed herein is for the purposes of description and should not be regarded as limiting.

As is well known in the art, a standard Bliss box consists of a body wrap or blank and two identical flat rectangular end pieces. Such boxes and a machine for fabrication thereof are shown in Moen and Roesner U.S. Pat. No. Re. 27,825. FIG. 2 shows an improved Bliss style box or container L of greatly improved stacking strength with but minimal increase in the quantity of material used and minimal decrease in the volume enclosed by the completed container. In the illustrated case, the completed box L is made of a body blank B and two identical end panel blanks E. While the body blank B is of standard form, the identical end panel blanks E are specially preformed with specially scored marginal flap areas C which are automatically formed into a tubular post P and a laminator tab T, integral with the end panel, which radically increase the compressive strength of the completed box.

Figure 1:
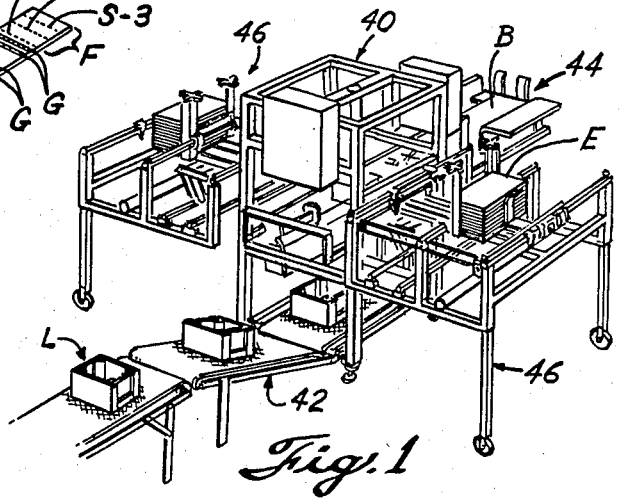
FIG. 1 is a perspective view of an automatic box making machine incorporating the invention, as adapted for the manufacture of so-called Bliss boxes.
Figure 6:
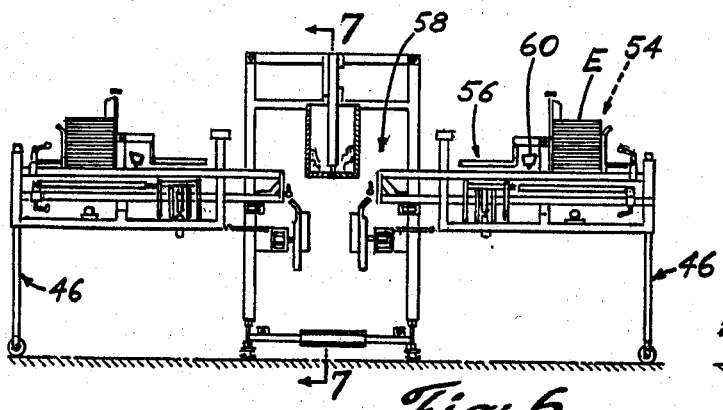
FIG. 6 is a longitudinal sectional view of the machine of FIG. 1, taken on the line 6—6 of FIG. 7.
Figure 7:
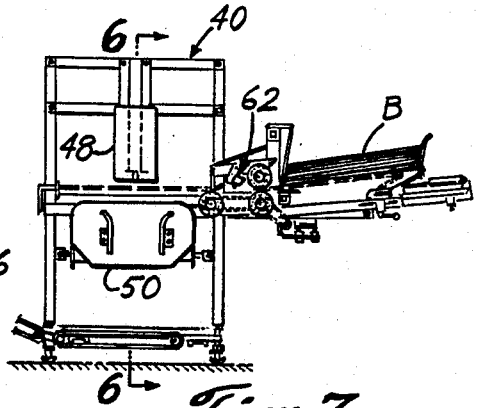
FIG. 7 is a transverse sectional view, taken on the line 7—7 of FIG. 6.

The presently preferred embodiment of machine for making the boxes L has the general arrangement shown in FIGS. 1, 6 and 7. A vertically elongate rigid framework 40 incorporates a vertically reciprocable mandrel 48 and a die cavity 50 which are essentially like the Bliss forming machine of the aforementioned U.S. Pat. No. Re. 27,825. Positioned beneath the framework 40 is a conveyor mechanism 42 onto which completed boxes L are dropped to be carried away to a point of use. At one side, in alignment with the conveyor mechanism 42, a hopper 44 is connected to the framework 40 to support a stack of horizontally disposed body blanks B. On a pair of opposite sides of the framework 40, flanking the conveyor mechanism 42, a pair of hoppers 46 are also connected to the framework 40 for supporting stacks of horizontally disposed end panel blanks E.

More particularly, referring to FIG. 6, each hopper 46 includes at its outer end a hopper station 54, an intermediate flap folding and laminating station 56, and an end panel erecting station 58 at its inner end. As is schematically indicated in the figure, glue applicators 60, such as in my U.S. Pat. No. 3,991,917, are also mounted on the hopper framework in order to deposit two pairs of parallel beads of glue G onto the upper surface of the blank E in its passage from the hopper station 54 to the forming station 56. As is shown in FIG. 2, the pairs of glue beads G are deposited onto those central panel areas of the blank E onto which which the tabs T are to be laminated.

FIG. 7 schematically illustrates a known mechanism, as shown in my U.S. Pat. No. 4,095,554, for feeding successive body blanks B inwardly of the body blank hopper 44, past glue guns 62 to deposit beads of glue G onto marginal flaps of the body blank B in a known pattern, as depicted in FIG. 2. As will be understood by those skilled in the art, the general mode of operation of the machine, after the end panel blanks E have been fully formed and erected into a vertical position, is for pawls mounted on the mandrel 48 to pick the erected end panels out of the hoppers 46 during the descent of the mandrel and to carry them and blank B into the die section 50 wherein the body blank B is wrapped around and adhesively secured to the end panels.

The end panel blank E preferably is made of so-called corrugated stock which, as is well known, comprises an intermediate corrugated paper layer sandwiched between a pair of flat paper skins. However, the blank E may be made of other sheet materials, provided that such other materials are susceptible of being preformed with a pattern of score lines defining areas of the blank that are bendable relative to one another.

More specifically, the blank E comprises a central rectangular section C that is flanked by an integral pair of flaps F. The junction of each flap F and the central section C comprises a score line S-1, while the area of the flap is marked with a parallel pair of score lines S-2 and S-3. It should be understood that in the case of corrugated paper stock the score lines S-1, 2 and 3 are made on the material parallel to the flutes of the intermediate corrugated layer. These scorelines are preferably of the perforated type although other types, e.g., crush scroes or slit scores, may sometimes be used. As will be apparent from FIG. 2, this disposition of the scores S-1, S-2 and S-3 permits folding of the area of a flap F out of the plane of the central section C and into the tubular post and laminator tab configuration.

The pair of hoppers 46 are essentially identical to one another. Accordingly, but one of them will be described in detail. Thus, referring to FIG. 8, each comprises a main frame 70 that incorporates a series of subframes 72, 74 and 76 of inverted U-shaped configuration projecting upwardly from an essentially rectangular horizontally extending frame 78. The frame 70 also incorporates a longitudinally extending midframe member 80 disposed along the midline thereof and terminating at its inner end in a subframe section 82 adapted for connection to the frame 40 of the Bliss box machine. The framework 70 is thus adapted to mount the hopper station 54 between the subframes 72 and 74, the flap folding and laminating station 56 in the area between the subframes 74 and 76, and the panel erector station 58 in the area inwardly of the subframe 76.

Figures 8, 9, 10, 11:
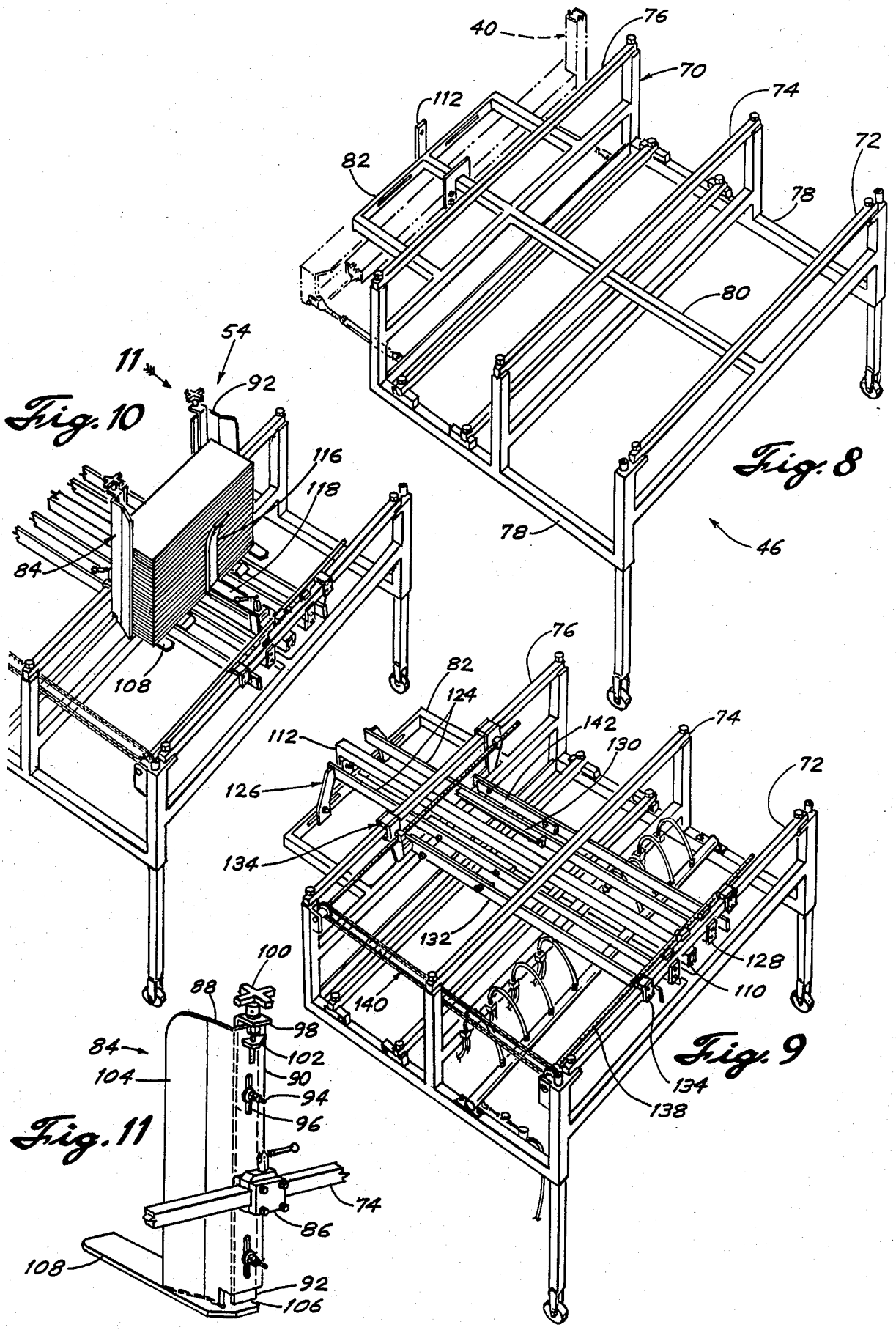
FIG. 8 is a perspective view of the framework for supporting the post forming and laminating mechanism of the invention.
FIG. 9 is a view similar to FIG. 8 but with added elements of structure comprising a portion of the mechanism for supporting box blank material in its passage through the machine.
FIG. 10 is a partial perspective view of a portion of the framework of FIGS. 8 and 9 with added structural elements defining a hopper for the material to be formed.
FIG. 11 is a fragmentary perspective view, on a larger scale, of a portion of the hopper structure of FIG. 10.

Referring to FIGS. 10 and 11, the hopper mechanism has a pair of gate post assemblies 84. Each of these is secured to the subframe 74 by an adjustable fastening means 86, whereby the pair of gate post assemblies 84 can be spaced apart to accomodate the particular long dimension of a given set of end panels E to be processed. Each of the gate post assemblies has a vertically extending member 88, that is generally L-shaped in horizontal cross sectional configuration, having a leg 90 disposed parallel to subframe member 74 and on the outside face of which the adjustable fastener 86 is secured. The inner face of the leg 90 mounts an elongate bar 92 which has a spaced apart pair of shafts 94 that extend through a pair of vertically elongate slots 96 formed in the leg 90 of the flanged member 88. The upper end of the bar 92 terminates in a horizontal flange portion 98 to support a screw mechanism 100 that is threadedly engaged with a tapped bore of a plate 102 that is secured to the backside of the leg 90.

The other leg of each flange member 88 includes a flared portion 104. As is indicated in FIG. 11, the short leg 90 of each member 88 is relieved, as indicated at gap 106, such that the lower end of the bar 92 protrudes downwardly thereinto. A rearwardly projecting support shoe 108 is rigidly secured to the lower end of the long leg of each flange member 88. As will now be apparent, the position of the lower edge of each bar member 92 can be set and fixed into an adjusted position of clearance relative to the upper surface of the corresponding shoe 108 such that only one blank E at a time can be propelled out the gate assemblies 84.

A shuttle guide tube 110 is mounted along the longitudinal center line of the main frame 70 in vertically spaced apart parallel relationship to the midframe member 80. More particularly, as best seen in FIG. 9, the tube 110 has its inner end secured to a bracket 112 projecting upwardly from the subframe 82 and has its outer end rigidly secured, by means of a bracket 114, to hang from the top rail of the subframe 72. The tube 110 thus centrally supports a stack of blanks E within the hopper mechanism and provides central support for each blank E as it progresses downstream therealong past the glue guns 60, through the folding and laminating station 56, and the end panel erector station 58. The tube 110 also supports a backstop 116 of the hopper mechanism 54 in an adjustable manner such that various widths of blanks E can be accomodated.

More specifically, the backstop 116 comprises an upstanding strap that terminates at its upper end in a flared portion. At its lower end, the backstop 116 is rigidly secured to one end of a support bar 118 extending rearwardly therefrom in slightly spaced apart parallel relationship to the guide tube 110. The outer end of support strap 118 is secured to a saddle clamp 120 on tube 110 which can be loosened and fastened to vary the position of the backstop 116 relative to the pair of gate posts 84.

Referring to FIG. 9, it will be seen that the central tube 110 is flanked by a parallel pair of inner support rails 124. Preferably the rails 124 are mounted for adjustment laterally relative to the support tube 110. Accordingly, the inner end of each of these rails is supported by means of a bracket 126 adjustably secured to the subframe 82 while the outer ends of the rails 124 are mounted on brackets 128 adjustably secured to the top rail of the subframe 72. Within that portion of their length corresponding to the folding and laminating station 56, the rails 124 are fitted with doublers 130 to broaden the surface to reactively support a blank E during the folding and laminating process.

The inner pair of rails 124 are, in part, flanked by a co-planar parallel pair of outer rails 132. More specifically, as also shown in FIG. 9, each of the rails 132 extends between the outer subframe 72 and the inner subframe 76 and at each of its ends is rigidly supported on a bracket 134 slidably secured to the top rail of the corresponding subframe 72 or 76. The pair of brackets on each of these top rails is threadedly engaged by right and left hand screws of a common adjustment shaft 138. As is indicated in the figure, the pair of shafts 138 are coupled together by a chain and sprocket system 140 such that they are co-rotated for adjustment in unison of the pair of brackets 134 on each of the subframes 72, 76. The outer pair of rails 132 are also fitted with doublers 142 in that portion of their lengths corresponding to the fold and laminating station 56.

Figure 13:
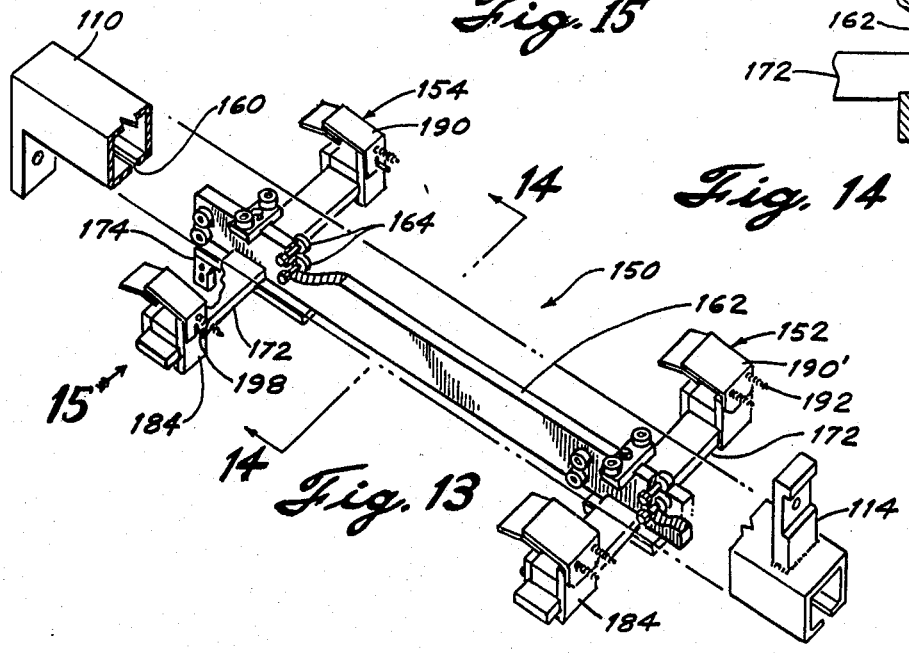
FIG. 13 is an exploded partial perspective view, having portions cut away, of a portion of a shuttle mechanism of the FIG. 12 structure.

Referring to FIG. 13, the guide tube 110 supports a shuttle, designated generally by the number 150, for transporting individual blanks E out of the hopper mechanism 54, under the glue guns 60, and through the fold and laminating station 56 and panel erecting station 58. The shuttle mechanism 150 is fitted with two pairs of shuttle blades 152, 154 such that upon each extension of the shuttle each set of blades advances a blank E one step through the process.

Figure 14:
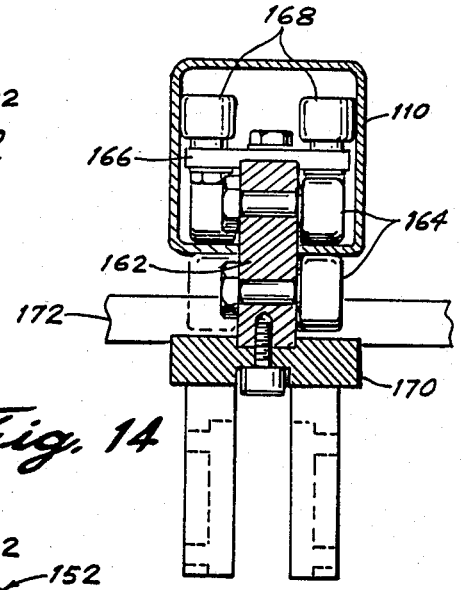
FIG. 14 is a sectional view, on a larger scale, taken on the line 14—14 of FIG. 13.

More particularly, the guide 110 comprises a length of tubing of essentially square cross-sectional configuration that is formed with a longitudinally extending slot 160 through its bottom wall, of sufficient length to accomodate the stroke range of the shuttle mechanism. The shuttle 150 has a body member 162 comprising an elongate bar longitudinally positioned with clearance within the slot 160. At its opposite end portions, the shuttle body 162 is fitted with two pairs of vertically spaced apart opposed rollers 164 having horizontal axes of rotation, one set of the rollers 164 being on the opposite side of the body member 162 from the other pair of the same set. As is best seen in FIG. 14 the clearance between a pair of adjacent rollers is such that they rollingly engage opposite sides of as to receive the bottom web of the square guide 110 therebetween. Internally of the tube 110, opposite ends of the shuttle body 162 have horizontally disposed brackets 166 secured thereto to support a laterally spaced apart pair of rollers 168 having vertical axes of rotation in rolling engagement with opposite ones of the vertical side walls of the tubing 110.

Figure 12:
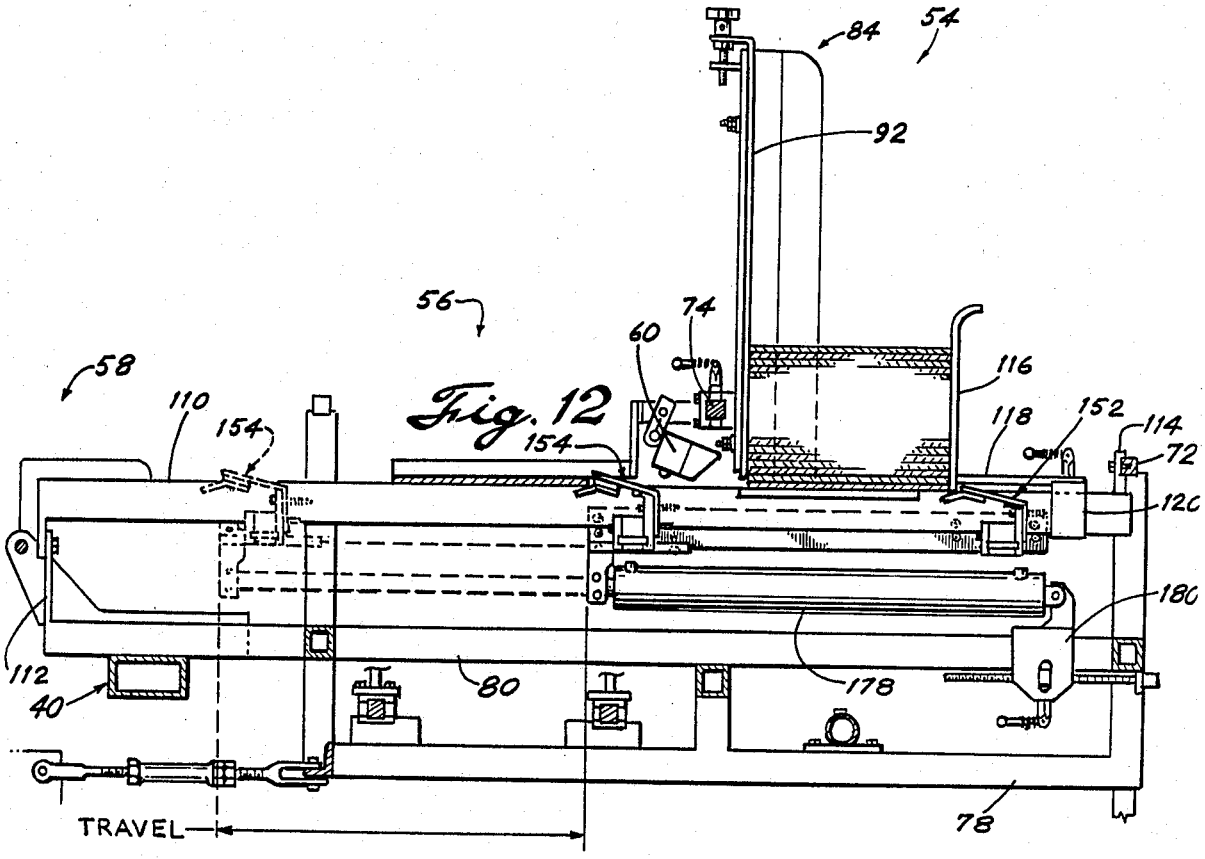
FIG. 12 is a longitudinal sectional view of the mechanism depicted in FIGS. 8–10.

Externally of the guide tube 110, the opposite ends of the shuttle body 162 are fitted with clamping members 170 for supporting one of a pair of transversely extending shuttle blade support bars 172. As is shown in FIG. 12, the inner end clamping member 170 includes a depending bracket 174 for connection to the outer end of a piston rod 176 whose other end mounts a piston within a pneumatic power cylinder 178. The outer end of the cylinder 178 is supported by means of a clamping bracket 180 adjustably mounted on the midframe member 80. The cylinder 178 is of a double acting type so that it is positively reciprocable in both directions depending on which side of the piston is exposed to fluid pressure.

Figure 15:
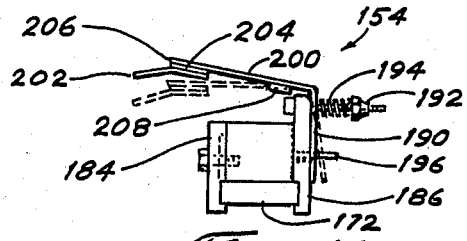
FIG. 15 is a side elevational view of a portion of the shuttle mechanism shown in FIG. 13, taken in the direction of the arrow 15 of FIG. 13 and on a larger scale.
Figure 17:
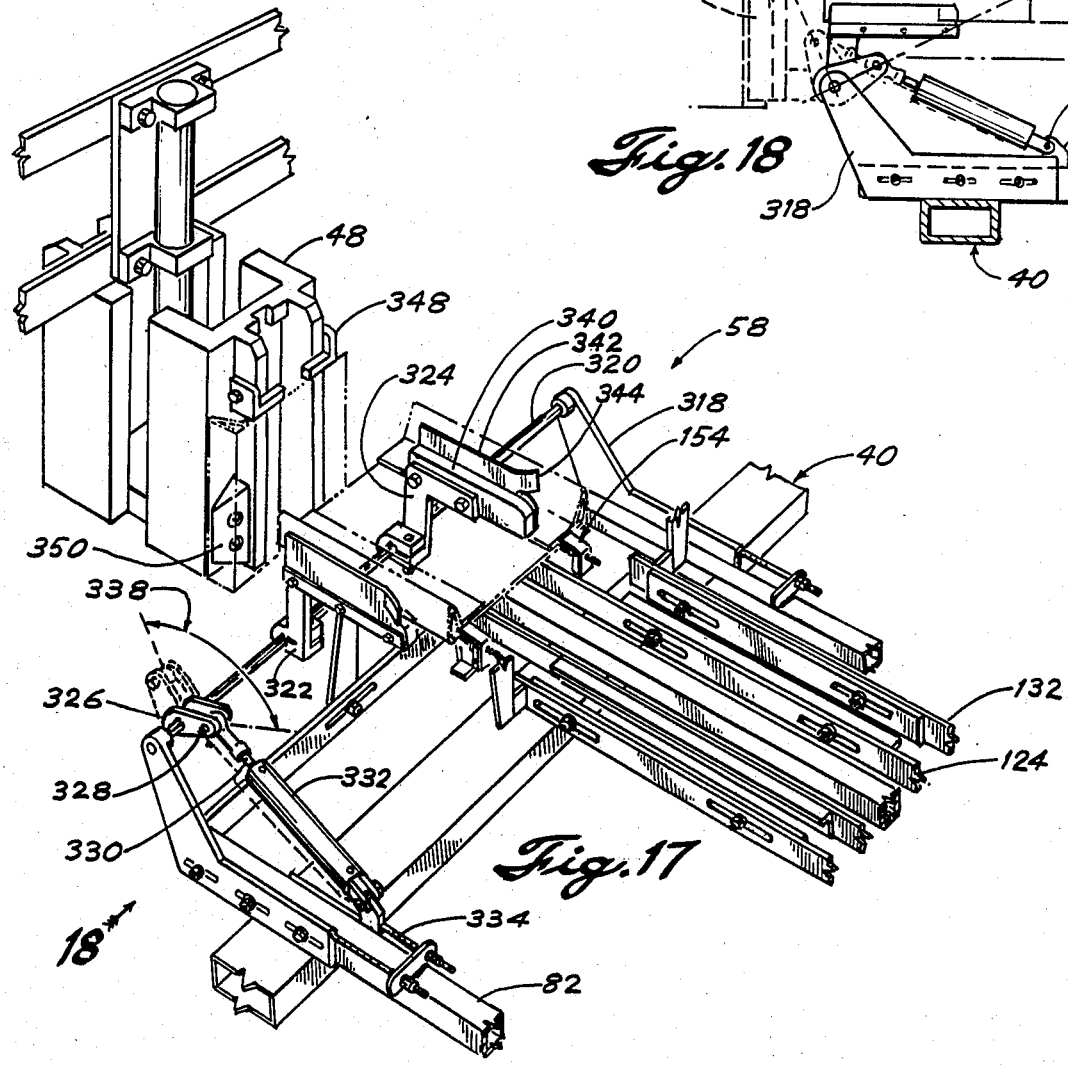
FIG. 17 is a partial perspective view, on a larger scale, of a portion of the mechanism of FIG. 16 and particularly showing details of a side wall panel erector mechanism adjacent a mandrel of a Bliss box forming machine.

The opposite ends of the outer support bar 172 are fitted with one of a pair of clamping brackets 184 in order to support the outer shuttle blades 152. In like manner, the inner support bar 172 also mounts a pair of the clamping brackets 184 at its opposite ends to support the inner shuttle blades 154. As is shown in FIG. 15, each of the clamp members 184 includes an upstanding leg 186 on its backside in order to support the corresponding shuttle blade 152, 154, as the case may be to, position the blades for driving engagement with an edge of a blank E to propel it inwardly on the top surfaces of the rails 124, 132, and tube 110. As is indicated in FIG. 17, the inner shuttle blades 154 are spaced apart on their support bar 172 so as to run with clearance between the support rails 124, 132 and corresponding doublers fastened to these rails. While not illustrated, it will be understood that the rear pair of blades 152 are similarly spaced apart so as to run with clearance between the support rails 124, 132 . As shown in FIG. 13, the rear blades 152 may be wider than the forward pair of blades 154 since the range of the former pair of blades does not extend into the reduced clearance defined by the doublers 130.

Referring to FIG. 15, the shuttle blade 154 includes an L-shaped drive plate 190 that is rockably mounted at the upper edge of the upstanding leg 186 of the corresponding clamping bracket 184. The vertical leg of the essentially L-shaped plate 190 is normally biased into flat engagement with the backside of the leg 186 by means of a nut and bolt assembly 192 that coaxially mounts a spring 194 under the head of the corresponding bolt. At the lower end of the leg 186, a guide pin 196 extends loosely through a vertically elongate slot 198 (FIG. 13.) in order to maintain a vertical orientation of the drive blade 190. The inwardly directed leg 200 of the drive plate is fitted on the underside of its free end with an inwardly projecting flanged lip 202 under an integral shim 204 to define an acutely angled shoulder which presents a relatively sharp drive edge 206 that is securely drivingly engageable with the rear edge of a panel. The root end of the leg 200 of the drive plate 190 is fitted on its underside with a transversely extending member 208 to be drivingly engaged by the inner face of the leg 186.

The rear or outer pair of laterally spaced shuttle blades 152 are essentially of the same construction as the inner shuttle blades 154. It may be noted, however, that the drive blades 190' of the rear shuttles 152 are wider than the forward or inner blades 190. Also, since the outer blades 190' engage only a single thickness of the blank E, they do not include the shim 204 of the inner blades 190. In lieu of the guide pin 196 of the inner shuttle blades 154, the outer shuttle blades 152 utilize a pair of the spring loaded nut and bolt fasteners 192.

Figure 16:
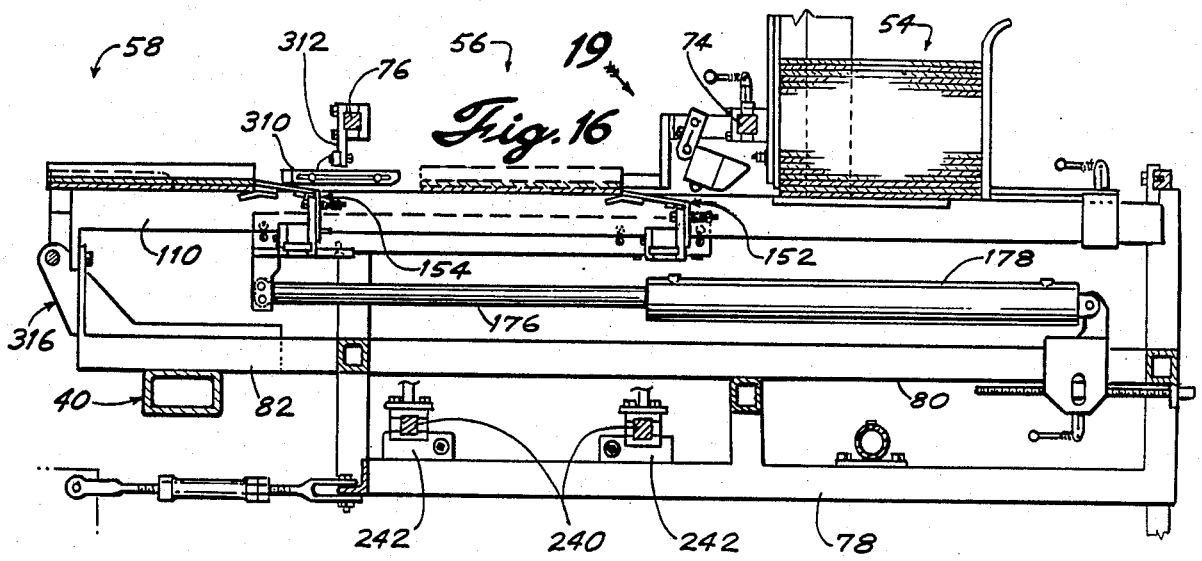
FIG. 16 is a side elevational view similar to FIG. 12 but showing some of the parts thereof in different positions relative to one another.

It is believed that operation of the shuttle mechanism 150 will be apparent from a comparison of FIGS. 12 and 16. Suffice it to say that, upon actuation of the cylinder 178, the shuttle body 162 is driven out of the FIG. 12 position, whereupon the outer laterally spaced apart shuttle blades eject a single panel E out of the hopper mechanism 54 and the inner shuttle blades 154 strip a previously folded and laminated panel E out the station 56 and into the panel erection station 58. No lateral edge guides neeed be used in the stations 54, 56 because of the efficiency of the shuttle mechanism. Then, when the parts are in the positions shown in FIG. 16, the cylinder 178 is again actuated to retract the shuttle body 162. Whereupon the shuttle blades 154 and 152 are deflected downwardly upon coming into contact with the panels in the preceding station and resume their upstanding positions at the end of the return stroke.

When the machine of FIG. 1 is employed for making boxes having only the corner posts P shown in FIG. 2, the pair of inner support rails 124 of FIG. 9 need not be employed and may be removed if desired. When the machine of FIG. 1 is adapted or set up for the manufacture of Bliss style boxes or end panels of the type shown in FIG. 3, having both corner posts P and internal ribs R, the inner pair of guide rails 124 and their associated doublers 130 should be employed in order to provide broad rigid reactive surfaces against which the marginal flaps of the material can be folded and laminated.

Figures 19, 20, 21, 22:
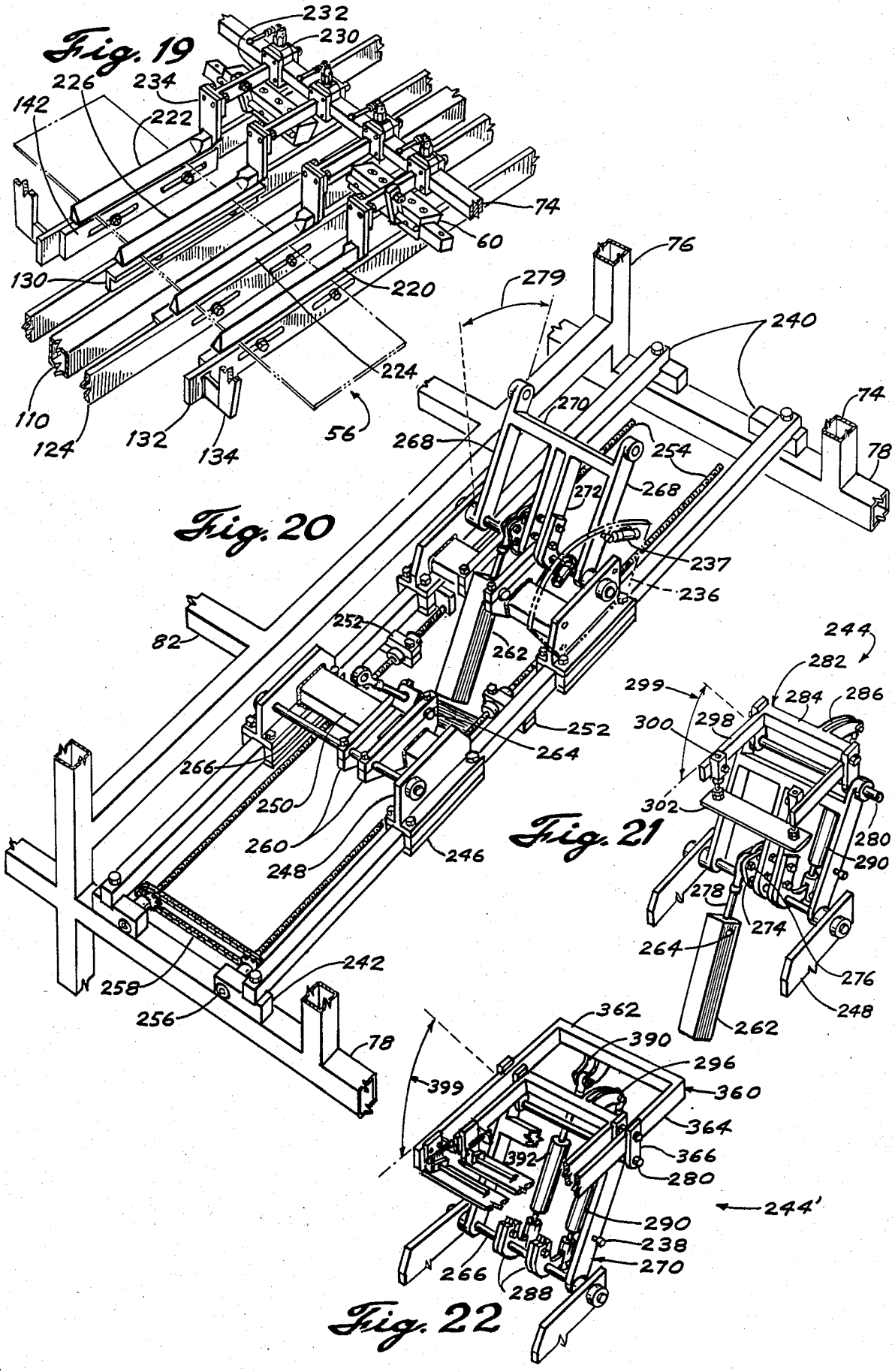
FIG. 19 is a partial perspective view, taken in the direction of the arrow 19 of FIG. 16, particularly showing an array of mandrels in the fold station of the mechanism of FIG. 12.
FIG. 20 is a perspective view of a flap folding mechanism of the fold station, parts of the mechanism having been removed for purposes of clarity of illustration.
FIG. 21 is a partial perspective view of a portion of the mechanism shown in FIG. 20, with additional structural elements.
FIG. 22 is a partial perspective view of the mechanism of FIG. 21 but as further adapted, particularly for utilization in the manufacture of the end wall of FIG. 3.

The folding and laminating process involves an array of mandrels such as are shown in FIG. 19. Thus, the figure shows a pair of corner post mandrels 220, 222 mounted in opposition to the pair of outer support rails 132 and a pair of rib mandrels 224, 226 mounted in opposition to the pair of inner support rails 124. Other subsequently described portions of the mechanism are also readily interchangeable between a configuration for making the corner post end panels of FIG. 2 or the post and rib panels of FIG. 3. Such variations will be apparent or pointed out as the description proceeds.

More specifically, each of the mandrels 220–226 is supported in parallel spaced relationship to its corresponding support rail by means of a bracket 230 secured to the top rail of the subframe 74. Projecting inwardly from the inner face of each bracket 230 is a support bar 232 whose inner end rigidly supports a depending mounting plate 234 to whose lower end the corresponding cantilevered mandrel is connected. The intermediate portions of the support bars 232 provide a means for securely mounting the glue guns 60 thereto in position to deposit the desired patterns of glue beads onto the upper surface of a blank passing thereunder. It will be noted that the corner post mandrels 220, 222 are of right triangular cross sectional configuration corresponding to the cross sectional configuration of the corner post P. The inner rib mandrels 224, 226 may be of substantially isosceles triangle cross sectional configuration, corresponding to the ribs R. It will, however, be appreciated that other cross sectional configurations may be employed.

As is indicated in FIG. 12, the array of corner post and rib mandrels is supported in a cantilevered fashion and they are so positioned with respect to their corresponding support rails to define a sliding fit with an end panel blank passing therethrough. While not illustrated due to the scale of the drawings, the mandrels are preferably inclined slightly downwardly inwardly to wedgingly drag on an end panel blank entering thereinto so that at the end of the stroke of the shuttle body 162 a brake is provided to positively stop the end panel blank at exactly the end of the shuttle stroke and in precise, indexed registration with the flap folding and laminating mechanism.

For clarity of illustration, the mechanism for folding and laminating the marginal flaps F of a blank E or the like has not been illustrated in FIG. 19 in its relationship to the array of mandrels 220–226. It is, however, to be understood that this mechanism is positioned in the station 56 sidewardly beneath these mandrels.

Figure 23:
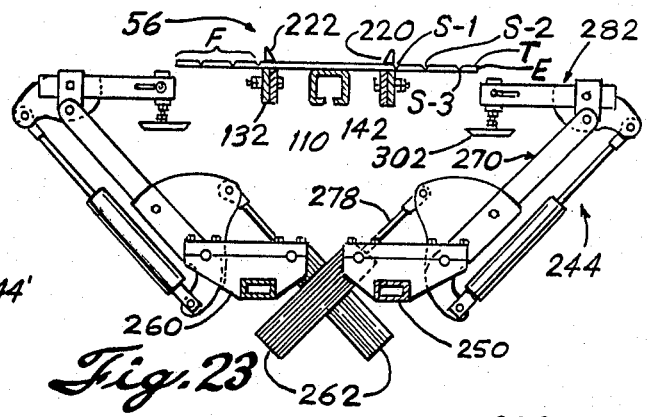
FIG. 23 is a partial elevational view of the folding mechanism of FIGS. 20 and 21 illustrated in operational relationship relative to the material to be operated upon.

More specifically, referring to FIG. 20, the folding and laminating mechanism is supported on a parallel pair of support rails 240 extending transversely between the opposite pair of lower frame members 78. As is shown in FIG. 16, the opposite ends of the support rails 240 are rigidly secured to the frame members 78 at the station 56 by means of mounting blocks 242. The pair of rails 240 support a pair of post folder mechanisms 244, one of which as is shown in FIG. 21, each of these mechanism being positioned slightly beneath and laterally adjacent one of the marginal flaps F of the stock to be folded and laminated as shown in FIG. 23. Since the pair of mechanisms 244 are essentially identical to one another, but one of them will be described.

More particularly, and referring now to FIG. 20, each of the mechanisms 244 is mounted on a pair of saddles 246 that slidably embrace the pair of support rails 240. The saddle assemblies include upstanding flanges 248 rigidly interconnected by a tubular crosspiece 250 whereby the pair of saddles are moveable in unison with respect to the support bars 240. At about its midpoint, each of the support bars 240 rigidly mounts a bearing block 252 that rotably supports the midsection of a right and left hand threaded screw shaft 254, each of the screw shafts at one end being mounted in a drive socket 256 mounted in one of one pair of the support blocks 242. A chain and sprocket mechanism 258 interconnects the pair of screw shafts 254 such that when one of the sockets 256 is turned or rotated, both shafts are turned whereby to adjust the spacing between the pair of mechanism 244 relative to one another, as desired, to accomodate different sizes of paper stock.

The cross member 250 of each fold mechanism 244 rigidly mounts a pair of parallel spaced apart bracket plates 260. As is shown in the figure, the bracket plates 260 are oriented transversely to the member 250 to project towards the opposite sides thereof. At their inner ends the bracket plates 260 pivotally support the upper end of a pneumatic cylinder body 262 therebetween, as by means of a hinge pin 264. As will subsequently appear, the cylinder body 262 undergoes angular movement relative to its hinge pin 264 during operation of the folding mechanism 244. Accordingly, so that the pair of cylinder bodies 262 of the adjacent pair of mechanism 244 do not interfere with one another during operation, their supporting brackets 260 are offset relative to one another and relative to the midpoint of the corresponding crossbar 250.

The outer ends of the pair of bracket plates 260 provide bearing support for a median portion of a trunnion shaft 266 whose opposite ends are journalled in the pair of upstanding flange members 248. The shaft 266 pivotally mounts at its opposite ends the radially inner ends of a parallel pair of legs 268 of a generally E-shaped frame member 270. The E-shaped member 270 includes an integral pair of intermediate parallel spaced apart legs 272 whose radially inner ends are also pivotally supported by the trunnion shaft 266. One of the legs 272 has a crank arm bracket 274 affixed thereto projecting inwardly to be pivotally connected, by means of a pin 276, to the outer end of a piston rod 278 that is drivably connected to a piston contained within the cylinder body 262. The cylinder 262 is preferably pneumatically operated and is of the double acting type to positively drive the piston in both directions to oscillate the E frame 270 through the arc 279 indicated in FIG. 20, on the order of 55° in the illustrated exemplary case.

The mass of the E frame 270 and other mechanism supported thereby is substantial. Accordingly, to cushion the mechanism at the opposite ends of its stroke, an arcuate plate 236, shown in phantom line in FIG. 20, is rigidly fixed alongside the flange 248 of one of the saddle assemblies 246 to mount a pair of shock absorber devices 237 spaced apart about 55° and in interfering alignment with a stud 238 projecting sidewardly from one of the legs 268 of the E frame 270.

Referring to FIG. 21, the radially outer ends of the legs 268 of the E frame 270 coaxially support a pivot shaft 280 in order to pivotally mount a generally U-shaped second frame 282. A cross piece 284 of the U frame 282 is formed with an integral pair of outwardly projecting bracket members 286 in alignment with an L-shaped bracket 288 that is rigidly secured to one of the intermediate legs 272 of the E frame 270. As is best seen in FIGS. 23–26, an outwardly projecting portion of the L-shaped bracket 288 and the upper brackets 286 on the U frame 282 support a double acting pneumatic power cylinder 290 and its piston rod 292 in essentially parallel link relationship to the E frame 270, through all phases of oscillation of the E frame 270 under the action of its actuating cylinder 262. Accordingly, the cylinder 290 is pivotally connected to the lower bracket 288 by means of pivot pin 294 while the outer end of the piston rod 292 is pivotally connected to the outwardly projecting end of the pair of brackets 286 by means of a pivot pin 296. The cylinder 290 oscillates frome 282 through the arc 299 about 60° in the illustrated case.

Referring again to FIG. 21, the U frame 282 includes a parallel spaced apart pair of inwardly projecting arms 298 whose ends are fitted with adjustable clamping brackets 300 in order to rigidly support an essentially rectangular, chamfered edge fold platen 302 therebeneath. The platen 302 is detachably mounted so that it can be replaced by platens of other sizes conforming to the particular size of box to be manufactured. In the illustrated case the platen 302 is sufficiently large enough to cover a substantial part of the area of the laminator tab T illustrated in FIG. 2 over essentially the full length of the tab.

FIG. 23 schematically indicates an end panel blank E at rest in the folding and laminating station 56. Thus, the blank E is centrally supported by the guide tube 110 while the marginal portions of the central section C of the blank adjacent the scorelines S-1 are supported on the pair of rails 132 and their associated doublers 142 and beneath the pair of corner post mandrels 220, 222. Each of the folding and laminating mechanisms 244 is depicted in an inoperative position at rest beneath one of the marginal flaps F of the blank E, wherein the E frame 270 is outwardly inclined while the U frame 282 extends horizontally inwardly. The sequence of movement of the parts relative to each other, in order to form the flap F into the desired corner post and laminator tab configuration, is as follows.

Actuation of the cylinder 262 is initiated in a direction to commence retraction of its piston rod 278. In the initial phase of retraction of the piston rod 278, the cylinder 290 is inactive with its piston rod 292 fully extended. Accordingly, the position of the U frame 282 relative to the E frame 270 remains relatively fixed during initial inward swinging movement of the E frame 270. The upper side of the U frame 282 is caused to engage the underside of the corresponding flap F, thus commencing folding of the flap about the scoreline S-1.

Figure 25:
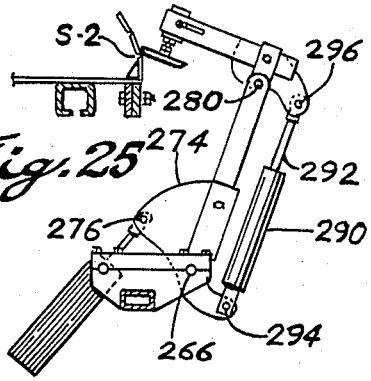

The piston rod 278 of the cylinder 262 continues its retraction but as the inner end of the U frame 282 approaches the corresponding support rail 142, the U frame cylinder 290 is actuated in a direction to commence retraction of its piston rod 292. The U frame 282 is thus forced to elevate its inner end bearing the platen 302 sufficiently to clear the corresponding mandrel 220 upon continued inward movement of the E frame 270 and U frame 282. As a result, the platen 302 moves non-linearly to effect folding of the marginal flap F against the mandrel 220 and about the scoreline S-2, as indicated in FIG. 25. While not specifically illustrated, it should be understood that retraction of the piston rod 292 into the cylinder 290 continues beyond the phase depicted in FIG. 25 to a degree sufficient to insure that the platen 302 will not be arrested or obstructed by the mandrel 220 in its continued inward movement against the flap F.

Figure 26:
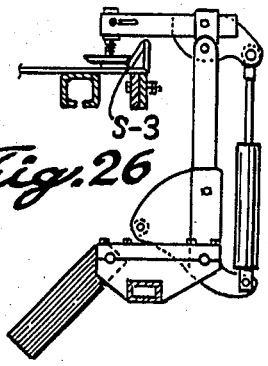

Upon continued retraction of the piston rod 278 of the cylinder 262 from the FIG. 25 to the FIG. 26 position, the cylinder 290 is now actuated in a mode to effect extension of its piston rod 292, effectively lengthening one link of the system, after the platen 302 has been moved inwardly sufficiently that it is not in registration with the mandrel 220. The platen 302 thus moves downwardly to effect folding of the flap about the scoreline S-3 to bear down on top of the laminator tab T which is thus adhesively secured to the central panel section C of the blank E. After the glue has been set the cylinders are actuated in a sequence which is the reverse of that described above in order to swing the mechanism 244 out of engagement with the completed end panel. The formed end panel is then stripped off the mandrels by means of the shuttle mechanism 150, out of the station 56 and into the panel erector station 58.

Referring to FIG. 16, a hold down shoe 310 is mounted on the top rail of the inverted U frame 76 between the station 56 and the panel erector station 58. The shoe 310 is mounted by means of an adjustable bracket 312 to position the shoe centrally and in spaced relation to the longitudinal guide tube 110. The adjustment means also permits vertical adjustment of the shoe 310 relative to the tube 110 to insure that a completed end panel in its transition from the station 56 into the station 58 is firmly pressed onto the guide tube 110. As indicated, the shoe 310 is of sufficient length to bear down on an end panel through substantially all of its travel between the stations 56 and 58.

An end panel erector mechanism 316 is mounted at the inner end of the hopper framework on the subframe 82 within the station 58. As is shown in FIG. 17, the erector mechanism 316 comprises an opposite pair of generally L-shaped brackets 318 rigidly but adjustably secured to opposite sides of the framework 82. The brackets 318 are formed with upstanding arms whose upper ends coaxially journal opposite ends of a rock shaft 320 therebetween. The rock shaft, in turn, supports a pair of brackets 322 that are keyed thereto, each of the brackets 322 being fitted with a rigidly mounted L-shaped bracket 324. Adjacent one of its ends, the rock shaft 320 has a crank arm 326 keyed thereto whose free end is pivotally connected, as at 328, to the outer end of a piston rod 330 that is driveably interconnected to a piston housed within a pneumatic cylinder 332 of the double acting type. The closed end of the cylinder 332 is pivotally connected by a pin 334 carried by a bracket 336 secured to the framework 82. As indicated by the directional arrow 338, actuation of the double acting cylinder 332 effects oscillation of the L shaped brackets 324 through 90° between horizontal and vertically disposed positions thereof.

Figure 18:
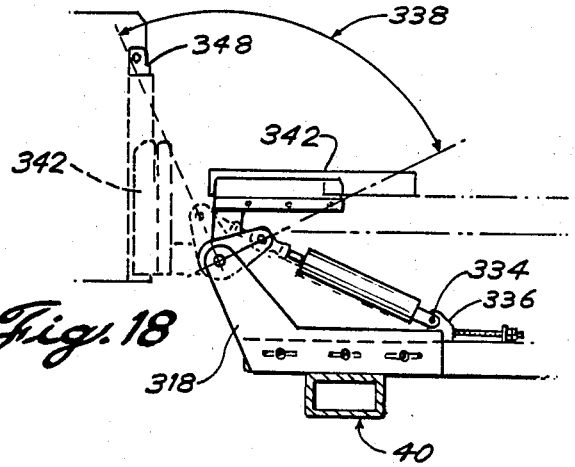
FIG. 18 is a partial side elevational view of the erector mechanism of FIG. 17, taken in the direction of of the arrow 18 of FIG. 17.

The outer end of each L-shaped bracket 324 is rigidly fitted with a support shoe 340 that is horizontally disposed in alignment with one of the support rails 132 when the piston rod 330 is in a retracted position. The outer surface of each shoe 340 is rigidly fitted with a sheet metal guide 342 whose upstream end is formed with an outwardly flared section 344 adapted for centering a formed end panel between the guides 342. The upper edges of the sheet metal guide 342 are inclined inwardly towards the centerline between the shoes so as to be slightly upwardly convergent in order to capture a end panel therebetween and, also, impart a drag or friction brake effect on the formed end panel so that the panel will stop precisely at the end of the stroke of the shuttle mechanism 150. As is indicated in FIG. 18, this orientation of the sheet metal guides 342 also serves to hold the vertically erect end panel in the proper position to be engaged by dogs 348 carried by the mandrel 48.

As is shown in FIG. 17, the mandrel 48 is adapted to accomodate the corner post configuration of the end panels by being fitted with triangular corner fillers 350 to react against the compressive forces imposed when the body wrap side wall glue joint is compressed against the face and side of the end panel. While not illustrated, it should be understood that when end panels including internal hollow ribs of the type of FIG. 3 are employed, the mandrel 48 is further adapted with blockers or the like having a negative impression conforming to the internal configuration of the post and rib structure of the end panel.

Figure 3:
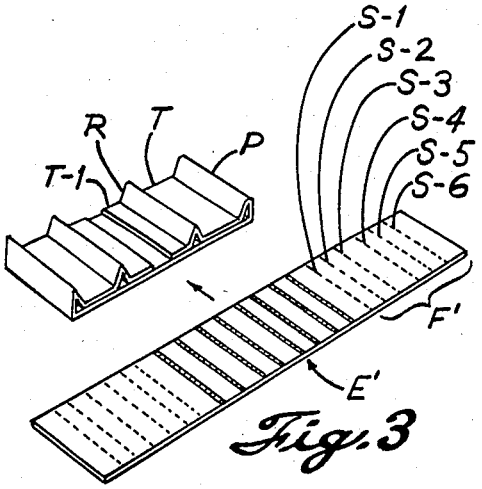
FIG. 3 is a flow diagram depicting the formation of an alternate form of end panel for a Bliss style box.

FIGS. 22 and 27–31 show an alternative embodiment of the folding and laminating mechanism 244', as modified for forming the end panel configuration of FIG. 3. As is shown in FIG. 3, the modified end panel of this invention has a second laminator panel section T-1, in addition to laminator panel T, and incorporates a hollow reinforcing rib R, in addition to the hollow reinforcing corner post P. The blank E-1 from which the modified end panel is made has each of its flaps F marked with six scorelines S-1 through S-6 defining the areas of the flap that are foldable relative to one another in order to achieve the desired formed rib and post configuration.

The modified folding and laminating mechanism 244' is shown in FIG. 22 and, with one modification to be pointed out presently, includes all of the elements of the folding mechanism 244 of FIG. 21. The modified mechanism of FIG. 22 includes a second U frame 360 having a base member 362 from opposite ends of which a parallel pair of legs 364 extend inwardly. As indicated, the legs 364 of the second U frame 360 are slightly longer than the legs 298 of the first U frame 282, while the base member 362 of the second U frame is slightly longer than the base leg 284 of the first U frame. Intermediate portions of the legs 364 are fitted with downwardly projectin clamp brackets 366, the lower ends of which journal opposite ends of the support shaft 280 that also pivotally supports the first U frame 282. The mounting arrangement is such that the first U frame 282 and the second U frame 360 are independently supported in essentially the same parallel plane, with the inner U frame being closely surrounded by the outer U frame, with clearance.

Figure 28:
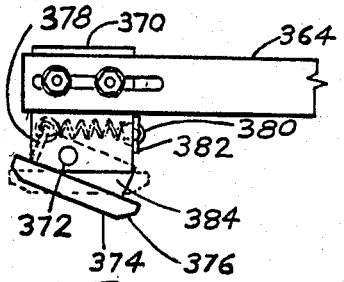
FIG. 28 is a partial side elevational view, on a larger scale, of a portion of the mechanism of FIG. 27.

Referring to FIG. 28, the inner end of each leg 364 of the second U frame is fitted with an adjustably mounted clamp bracket 370. A pivot pin 372 is journalled in a downwardly projecting portion of the bracket 370 and is connected to one end of a rectangular platen 374 whose other end is supported in the same fashion on a coaxial pin 372 in the bracket 370 on the other arm 364. Preferably, the opposite longitudinal edges of the platen 374 are formed with a downwardly facing chamfer 376 complementary to the slope of a face of mandrels 224, 226. At one end the platen 374 is fitted on its upper surface with an upstanding eye 378 to which one end of a spring 380 is interconnected. The other end of the spring is hooked to an anchor member 382 secured to the bracket 370. As the spring 380 is positioned above the coaxial pair of hinge pins 372, the platen 374 is normally biased into the solid outline position shown in FIG. 28. A stop 384 is fixed on top of the platen 376 in alignment with the anchor 382 to arrest the platen in the phantom outline position.

Preferably, the mounting for the platen 302 of the mechanism 244' is also modified to include the spring biasing arrangement just described for the platen 374 of the second U frame 360, although a rigidly mounted platen 302 can be employed in some cases.

Figure 27:
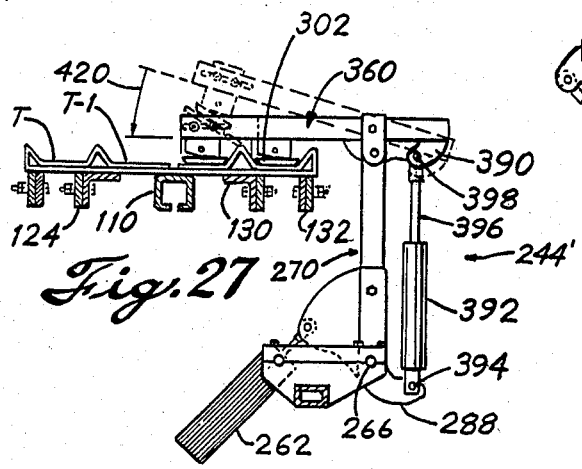
FIG. 27 is a partial elevational view of the mechanism of FIG. 22.

Referring to FIG. 22, in order to actuate the second U frame 360, the mounting shaft 266 for the E frame 270 is fitted with a second L shaped crank member 288, offset from the first crank member 288. This second crank member may be fastened onto the other intermediate leg 272 of the E frame member and, like the first, has its lower end projecting sidewardly outwardly essentially in registration with the first L crank member 288. The base leg 362 of the second U frame member 360 is fitted with a rigid bracket 390 that projects downwardly and inwardly in alignment with the second L bracket 288. A pneumatic double acting cylinder 392 has its body pivotally interconnected at 394 to the projecting end of the second bracket 288 and has a piston rod 396 pivotally connected, as by a pin 398, to the inwardly projecting end of the bracket 390. As is shown in FIG. 27, the pneumatic cylinder 392 is thus supported in essentially parallel relationship to the E frame 270 with its pivot points 394, 398 essentially coaxially aligned with the pivot points 294, 296, respectively, for the cylinder 290 of the first U frame 282. In the case of the both the first or inner U frame 282 and the second or outer U frame 360, their corresponding power cylinders 290 and 392 are variable length link parts of a parallelogram linkage arrangement, the other long leg of which comprises the E frame 270. The cylinder 392 reciprocates the frame 360 through an arc 399 of about 90° in the given case.

Figure 24:
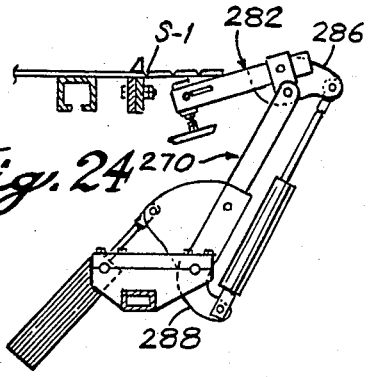
FIGS. 24–26 are views of the mechanism on the right hand side of FIG. 23 in various phases of operation.
Figure 30:
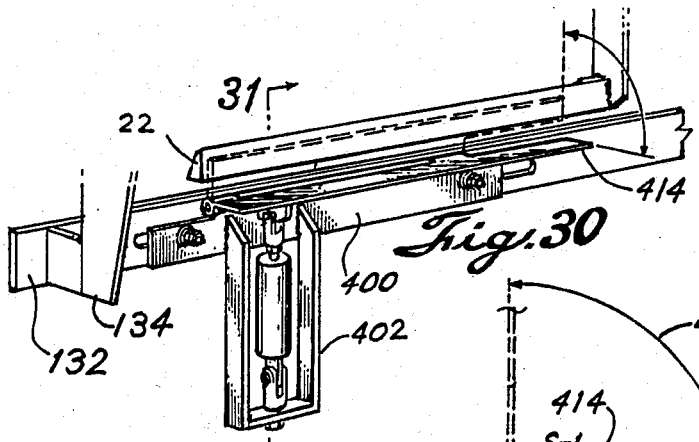
FIG. 30 is a partial perspective view of a marginal flap erecting mechanism employed in conjunction with the mechanism of FIGS. 22 and 27–29.
Figure 31:
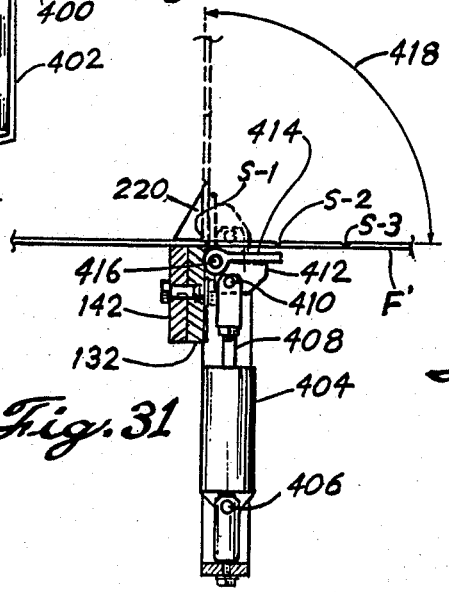
FIG. 31 is a sectional view on the line 31—31 of FIG. 30.

In the case of the end panel blank E of FIG. 2 the flap flap F is relatively short as compared to the corresponding flap F' of the blank E' of FIG. 3. In the former case, it is sufficient to rely on a cam-like action of the U frame 282 of the mechanism 244 to initiate the folding of the flap F, as schematically indicated in FIG. 24. However, in the latter case it is preferable to initiate folding of the flap F' independently of actuation of the modified folding and laminating mechanism 244' of FIG. 22. An exemplary means of first folding a flap F' is shown in FIGS. 30 and 31. The same means would normally be visible in FIG. 27 but has been deleted therefrom in order to preserve clarity of illustration of the mode of action of the modified mechanism 244'.

More particularly, and now referring to FIGS. 30 and 31, each of the pair of the outer support rails 132 is fitted on its outer surface with a bar 400 from which an integral essentially U shaped bracket 402 depends. The lower end of a double acting pneumatic cylinder body 404 is pivotally connected to the lower end of the bracket 402, as by a pin 406. A piston rod 408 extends through the upper end of the cylinder body 404 and is pivotally connected by a pin 410 to a bracket 412 rigidly affixed to the underside of an elongate rectangular fold plate 414. The plate 414 is, in turn, hingedly connected, as at 416, at spaced locations along the upper edge of the mounting plate 400. As is indicated by the directional arrow 418, the fold plate 414 is turnable through 90° under the linear action of the cylinder 404. the following description of the mode of operation of the modified fold and laminating mechanism 244', it will be understood that the cylinder 404 is actuated to turn the relatively long flap F' from the horizontal to the vertical position, in which the flap is arrested by the vertical face of the overlying corner post mandrel 220, prior to actuation of the cylinder 290 for the inner U frame 282 and the cylinder 392 for the outer U frame 360.

In the manufacture of boxes having the rib and post configuration of FIG. 3, a pair of the alternate mechanisms 244' are employed, one at each side of the machine. In this connection, it will be observed that the mechanism 244 of FIG. 21 can very quickly and easily be modified to the FIG. 22 configuration merely by the addition of the outer U frame 360 and its actuating cylinder since only three attachment points are involved.

The cylinder 404 for the fold plate 414 may be energized in advance of or simultaneously with the cylinder 262 for the E frame 270. In either case, the inner U frame and its platen 302 undergo the sequence of relative movements depicted in FIGS. 23–26 to form a corner post P around the mandrels 220, 222. During this sequence of steps, cylinder 392 for the outer U frame 360 remains inactive with its piston rod 396 fully extended until the inner frame 282 is in approximately the orientation depicted in FIG. 25. Thereupon, the cylinder 392 is actuated in a direction to slightly retract its piston rod 396 during that phase of the operation in which the inner frame 282 is translated from its FIG. 25 position to its FIG. 26 position. The outer U frame is thus elevated slightly relative to the inner U frame 282 as is indicated by the phantom outline position of the outer frame 360 indicated in FIG. 27. Thereupon, or slightly in advance of the inner platen 302 bottoming on the panel area T, the cylinder 392 is reversely actuated to extend its piston rod 396 thereby effecting movement of the outer frame 360 and its platen 376 through the arc 420 from the phantom outline position to the solid outline position shown in FIGS. 27 and 29.

Figure 29:
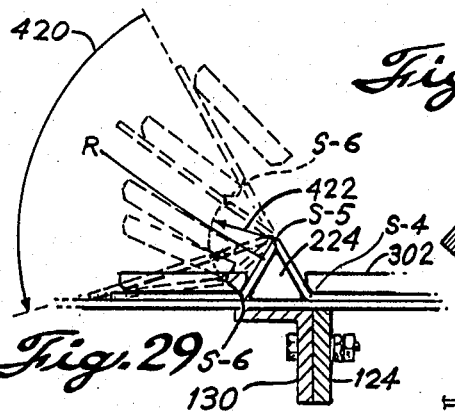
FIG. 29 is a schematic partial side elevational view illustrating, in phantom outline, different phases in the operation of the structure shown in FIG. 28.

The mode of operation of the spring biased platen 376 during movement of the outer frame 360 through the arc 420 is shown in FIG. 29. Essentially, the biased mounting of the platen 376 permits travel of its inner edge along a radius 422 comprising the spacing between the scorelines S-5 and and S-6. As a result, the area of the panel F' outwardly of the scoreline S-5 is first turned essentially bodily over the apex of the rib mandrel 224 or 226, as the case may be, and after an increment of arcuate movement the inner edge of the platen 374 yieldably bears against the scoreline S-6 to "break" the material along that scoreline and the terminal flap area outwardly of the scoreline S-6 is then pressed flat against the center panel of the end wall material when the platen 376 bottoms out against its stop 384.

In order to avoid interference between the end portions of the flaps F' during the sequence of steps depicted in FIG. 29 it is preferable that the cylinder 392 of one of the pair of fold and laminating mechanisms 244' be actuated slightly in advance of its companion so that one rib R and its associated laminator flap is formed slightly before the other.

Figure 5:
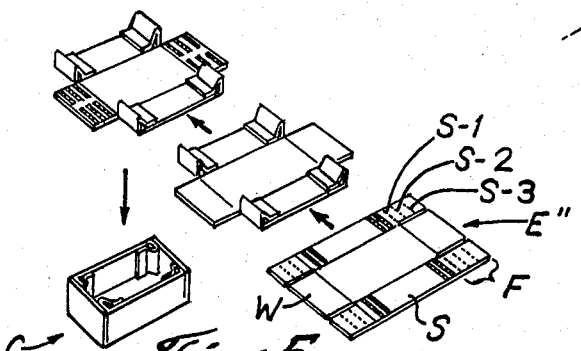
FIG. 5 is a flow diagram illustrating manufacture of tray style boxes resulting from utilization of the machine of FIG. 4.
Figure 4:
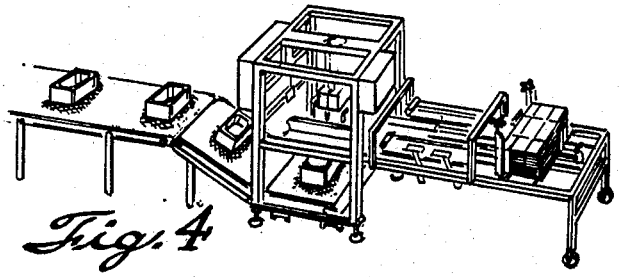
FIG. 4 is a perspective view of an alternative embodiment of the invention incorporated in a machine for automatically making tray style containers embodying the invention.

In FIG. 4 the invention is represented as embodied in a machine adaped for making tray style boxes C, shown in FIG. 5, having integral corner posts. In this case, the box C is of one piece construction being made from a single flat blank E″ which is scored to define a rectangular bottom panel that is flanked by an opposite pair of wall panels W and another opposite pair of side wall panels S, each of which is flanked by an opposite pair of marginal flaps F″. Each of the marginal flaps F″ is scored with scorelines S-1, S-2, and S-3, as in the case of the blank E in FIG. 2. The machine 430 of FIG. 4 has an essentially conventional mandrel and die arrangement but incorporates a modified hopper mechanism 46′ of the invention, similar to those of the FIG. 1 machine.

Figure 32:
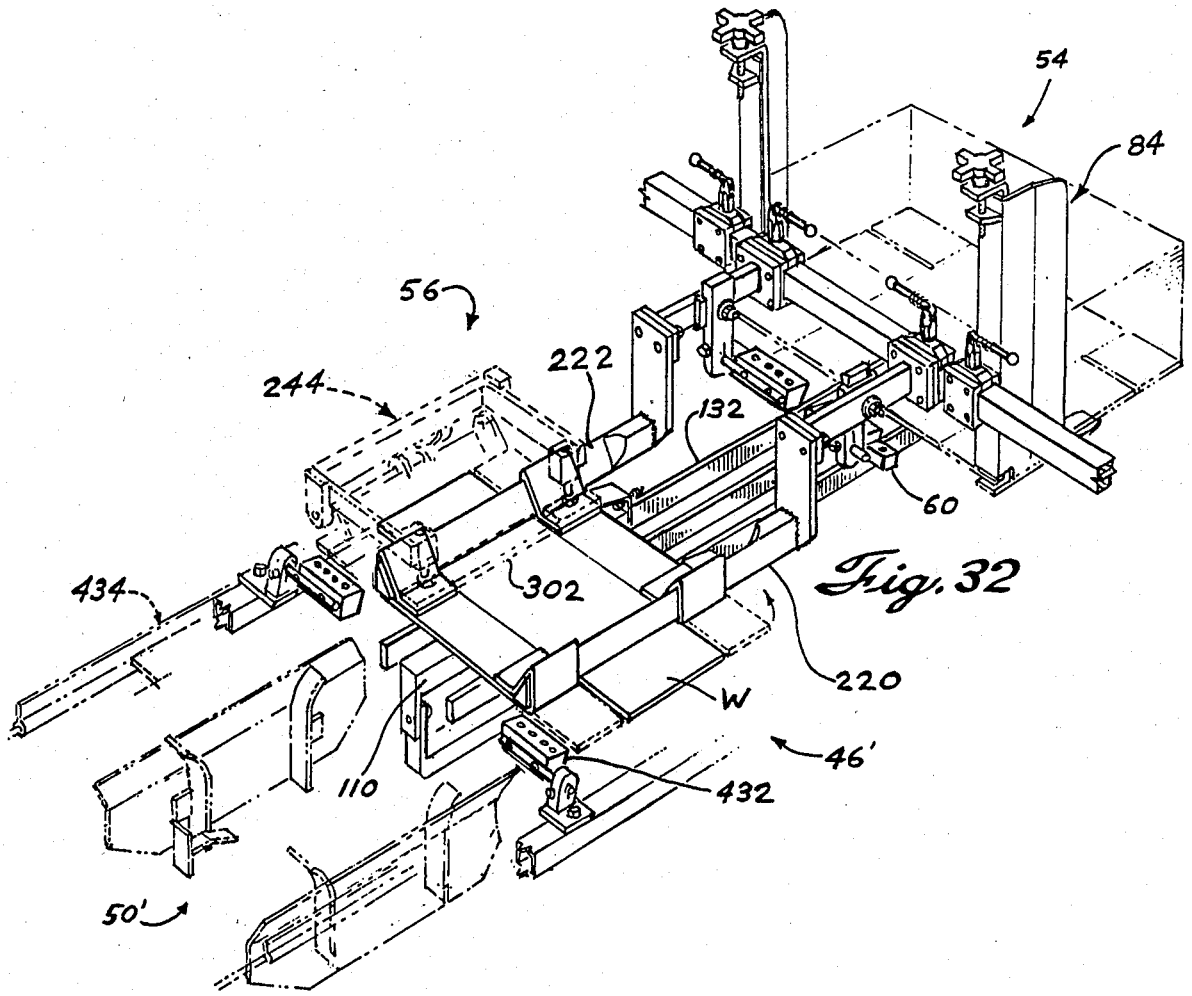
FIG. 32 is a schematic perspective view of portions of the mechanism of FIG. 12 as especially adapted for utilization in the tray style machine of FIG. 4.

Referring to FIG. 32, the modified hopper mechanism 46′ includes a hopper station 54 with gate posts 84, a set of glue guns 60, a folding and laminating station 56 having a pair of folding and laminating mechanisms 244, but omits a panel erector station 58, which is unnecessary in the case of the tray box. While not shown, it will be understood that the modified hopper mechanism 46′ includes a shuttle mechanism 150 such as is shown FIGS. 12–15. The operation of the folding and laminating mechanisms 244 is as described before, except that in this case each platen 302 manipulates a pair of the flaps F″ to form a pair of corner posts P. Thereafter, actuation of the shuttle mechanism 150 advances the partially formed blank stripping it off the mandrels 220, 222 to advance the end wall flaps W beneath a set of second glue guns 432 and into an indexed position supported on a pair of edge guide rails 434 over a die cavity 50′ wherein the completed box is formed by a descending mandrel.

Figure 33:
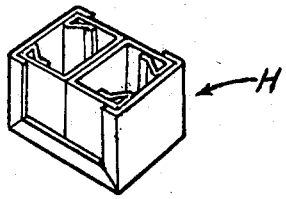
FIG. 33 is a perspective view of an H-divider style of Bliss container embodying the invention.
Figure 34:
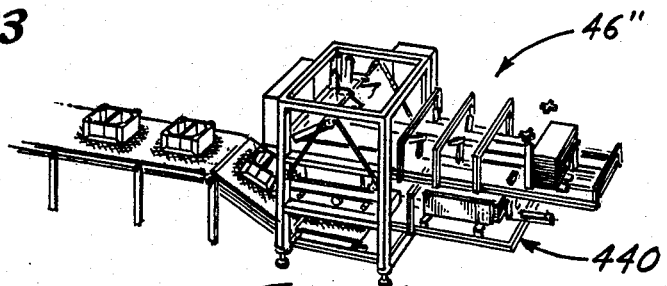
FIG. 34 is a perspective view of a Bliss style H-divider machine incorporating the invention as adapted to produce the container of FIG. 33.

FIG. 34 shows an H-divider container making machine of the type shown in my U.S. Pat. No. 4,315,752 except that it has been modified to make an H-divider container H such as is shown in FIG. 33 having integral corner posts, in accordance with the present invention. The machine has an upper hopper 46″ which handles the blanks which will be formed into the H-divider portion of the completed container, and a lower hopper 440 to handle the body wrap blanks to be formed around the H-divider portion. In this case, the upper hopper 46″ is essentially the same as the hopper arrangement 46′ of FIG. 32 except for a reversal of certain parts. Thus, the mandrels 220, 222 are inverted to lie beneath the sheet stock while the pair of folding and laminating mechanisms 244 are also inverted to operate from a position above the sheet stock. In other respects the operation of the overall machine is essentially the same as in my aforesaid U.S. Pat. No. 4,315,752.

Figure 35:
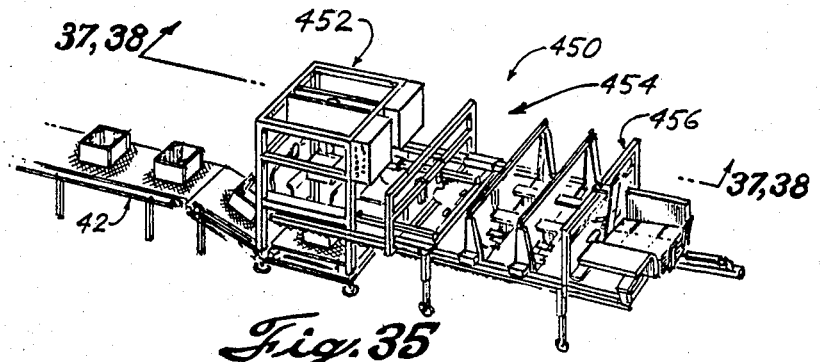
FIG. 35 is a perspective view of yet another embodiment of the invention that is adapted for making tray containers such as either FIG. 5 or FIG. 36.
Figure 36:
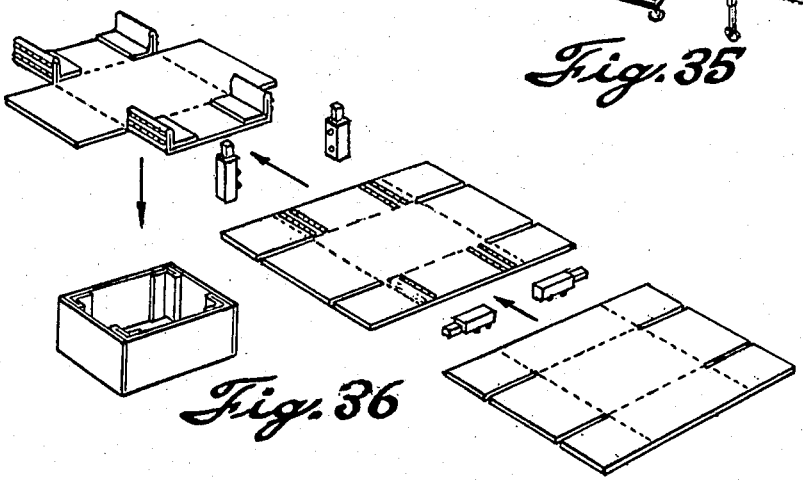
FIG. 36 is a perspective flow diagram of the making of one style of tray style box, resulting from utilization of the machine of FIG. 35.
Figure 37:
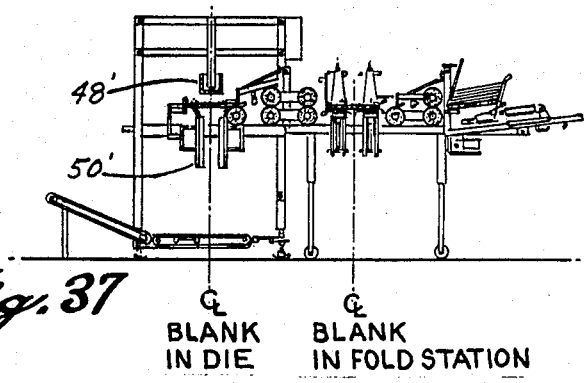
FIG. 37 is a longitudinal sectional view of the machine of FIG. 35 taken on the line 37—37 of FIG. 35.
Figure 38:
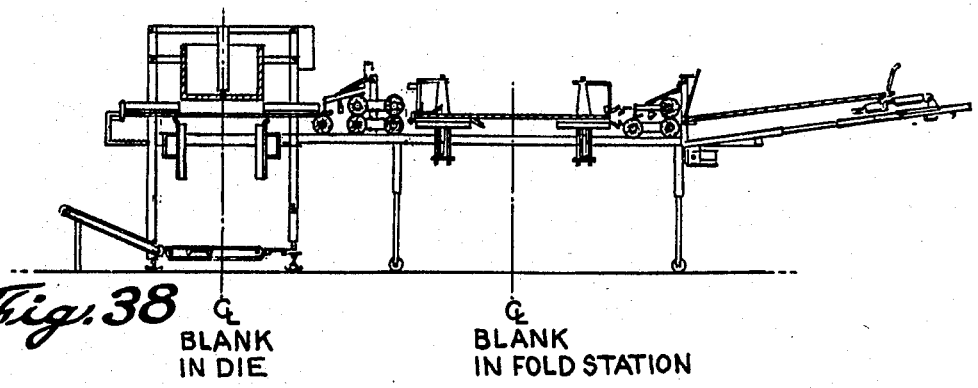
FIG. 38 is another longitudinal sectional view of the machine of FIG. 35, taken on the line 38—38, showing a different adjusted position of the machine.

FIGS. 35, 37 and 38 show the general arrangement of a machine 450 for making corner post reinforced tray style boxes such as, for example, those shown in FIGS. 5 and 36. In this embodiment, the machine has a vertically elongate, generally box-like main framework 452 that incorporates a vertically reciprocable mandrel 48′ and die cavity 50′ specifically adapted for the making of tray style boxes. The mandrel and die are conventional and are of a size-adjustable type as indicated by a comparison of FIGS. 37 and 38.

As before, the machine 450 has a conveyor mechanism 42 one end of which is positioned beneath framework 452. to receive completed boxes. At one side of the central frame 452, an inner feed frame 454 is connected thereto and an outer feed frame 456 is connected to the inner feed frame. The arrangement is such that the inner feed frame 454 can be adjusted inwardly and outwardly relative to the mainframe 452 while the outer feed frame 456 is adjustable inwardly and outwardly relative to the inner frame 454. As will subsequently appear, it is this relatively adjustable relationship of the three frames, in conjunction with the components carried thereby and in combination with the improved shuttle mechanism of FIGS. 45–50, which adapts the machine 450 to handling a very wide range of sizes of flat body blanks which are to be erected into a container.

Figure 39:
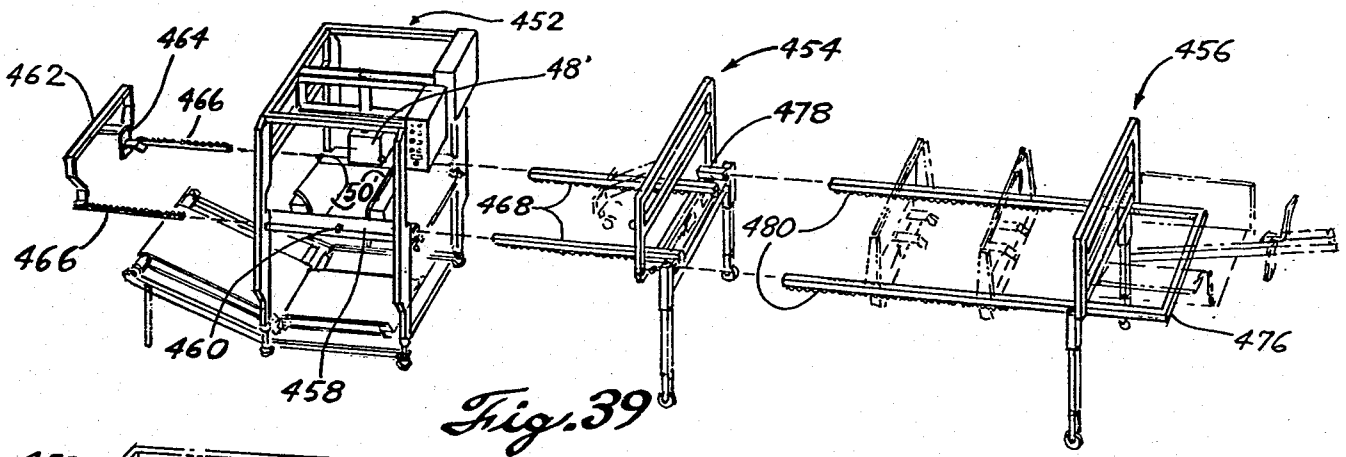
FIG. 39 is an exploded perspective view of subframes of the machine of FIG. 35.

Referring to FIG. 39, the mainframe 452 includes a parallel pair of horizontally extending hollow box beam framing members 458 disposed on opposite sides of the die cavity defining members 50′. Each of these mounts an equalizer sprocket 460, the two sprockets being coaxially aligned for rotation on a horizontal axis that substantially bisects the die cavity 50′. An inverted U frame 462, that mounts a material stop means 464, has the lower ends of each of its vertically extending legs fixedly secured to one end of a horizontally extending rack 466. Each of these racks is receivable within one of the hollow beams 458, with the teeth of the rack facing upwardly for engagement with one side of one of the equalizer sprockets 460.

Figure 40:
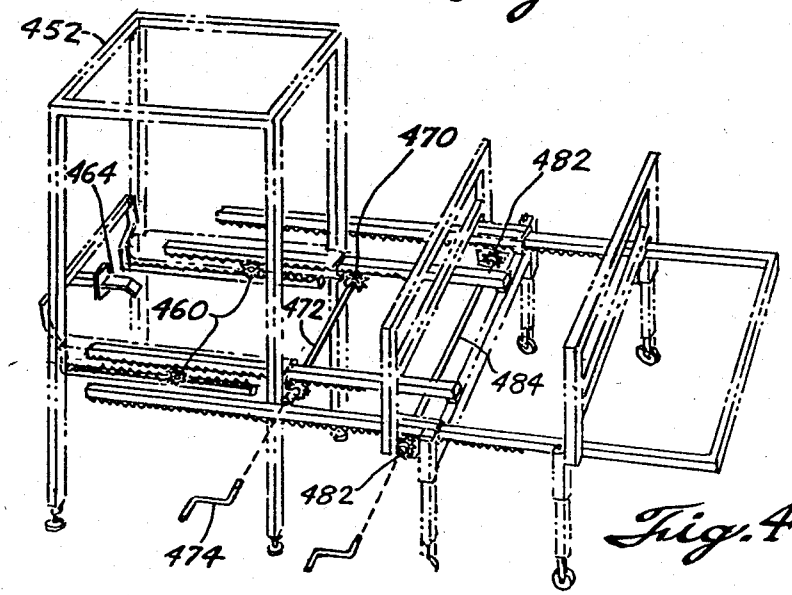
FIG. 40 is a perspective view showing in phantom outline an assembled relationship of the subframes of FIG. 39, with adjustment mechanisms thereon indicated in solid outline.
Figure 41:
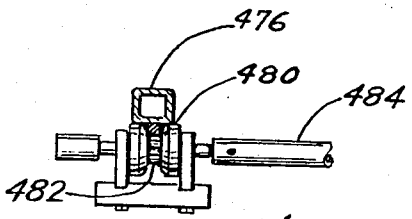
FIG. 41 is a transverse sectional view of a portion of part of the adjustment mechanism of FIG. 40, on a larger scale.

In a similar fashion, the inner feed frame 454 is fitted on opposite sides with a pair of rack bearing members 468 extending horizontally inwardly in alignment with the box beams 458 of the mainframe 452. The teeth of the pair of racks 468 face downwardly and, thus, upon insertion within the box beams come into driveable engagement with the top of one of the pair of equalizer sprockets 460. As is best seen in FIG. 40, the mainframe 452 is fitted on one side with a co-axial pair of bearing blocks, or the like, for supporting a pair of drive sprockets 470 on opposite ends of a common drive shaft 472. A hand crank 474 is fittable on one end of the shaft 472 for driving the drive sprockets 470 in unison. As will be apparent this arrangement effects mutual longitudinal reciprocation in opposite directions of the pairs of racks 468 and 466 in response to rotation of the crank 474 in one direction or the other. As a result the material stop means 464 and material feed components mounted on the inner feed frame 454 can be equally spaced on opposite sides of the center line of a blank over the die cavity 50′. A wide range of box blank sizes can thus be accomodated from a relatively small one, as indicated in FIG. 37, to a relatively large one, as indicated in FIG. 38.

Referring again to FIGS. 39 and 40, a somewhat similar arrangement is employed for spacing components carried by the outer feed frame 456 relative to the components carried on the inner feed frame 454. Thus, the outer feed frame 456 includes a horizontally extending U frame 476 having rack bearing legs 480 extending horizontally inwardly in alignment with a pair of hollow guide tubes 478 horizontally disposed on opposite sides of the inner feed frame 454. The under side of each of the legs 480 of the U frame 476 is fitted with a rack while the inner feed frame 454 is fitted with a coaxial pair of sprockets 482 mounted on opposite ends of a common drive shaft 484. As shown in FIG. 40, the racks 480 are driveably engageable with the sprockets 482 when the horizontal legs of the U frame 476 are inserted into the horizontal guide tubes 478. As indicated in the figures, the frames 452, 454 and 456 are all wheel mounted for ease of adjusting movement of the several sub-assemblies. As will be apparent the hand crank 474 can be coupled to one end of the shaft 484 to effect inward and outward movement of the outer feed frame 456 relative to the inner feed frame 454. As a result, the components of the two sub-assemblies are readily adjustable relative to each other to accomodate a wide range of possile sizes of box blanks to be handled in the apparatus, as indicated in FIGS. 37 and 38.

Figure 43:
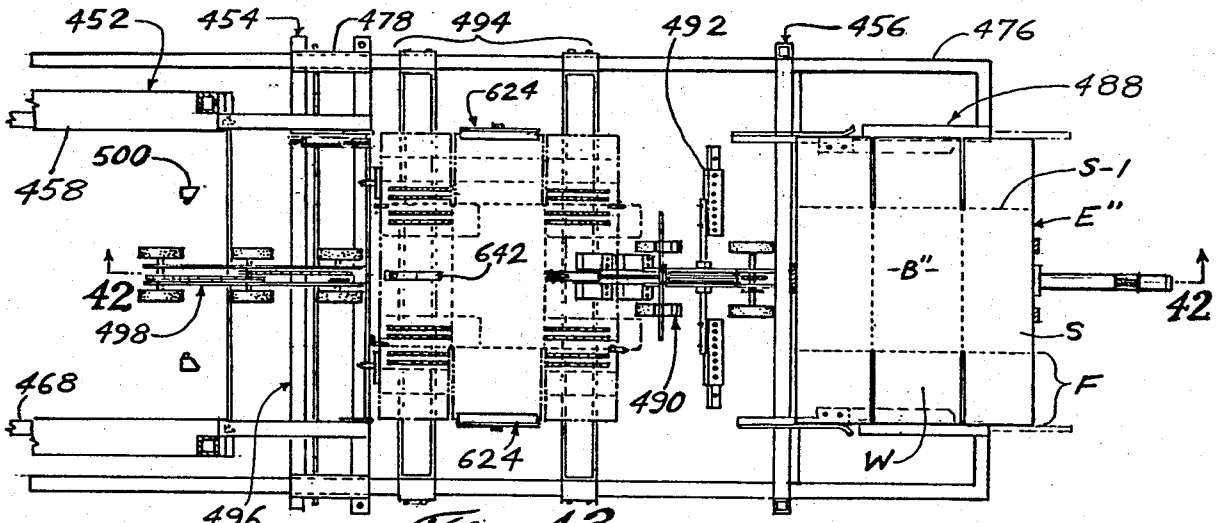
FIG. 43 is a partial sectional view taken on the line 43—43 of FIG. 42.
Figure 42:
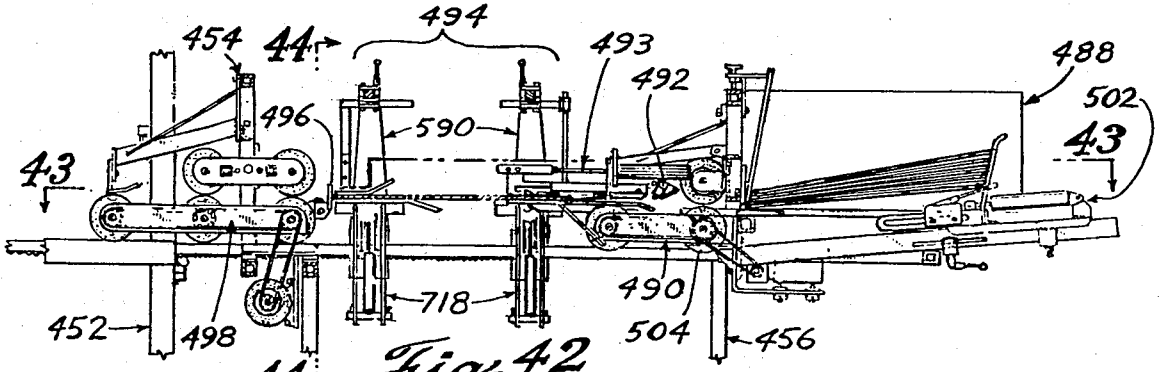
FIG. 42 is a longitudinal sectional view taken on the line 42—42 of FIG. 43.

Referring to FIGS. 42 and 43, the frames 452, 454 and 456, and the respective components of each, are shown in an exemplary operative relationship to one another to handle an exemplary tray body blank E" of a specified length and width. Proceeding inwardly from its outer end, the outer feed frame 456 mounts a body blank hopper means 488, outer frame body blank drive wheel assembly 490, glue gun assembly 492, shuttle mechanism 493 and flap folding and laminating mechanism 494. Proceedingly inwardly from the outer feed frame, the inner feed frame 454 supports the components of retractable stop means 496, inner drive wheel assembly 498 and optional second glue gun assembly 500.

The hopper, drive wheel and glue mechanisms are of known construction as indicated in my U.S. Pat. No. 4,310,323. The hopper assembly 488 to support any one of a wide range of sizes of preformed blanks above a kicker cylinder 502 for individually stripping the bottom one of the blanks from the stack. The kicker cylinder is adjustable relative to the fixed downstream hopper wall and has a sufficient stroke to deliver a blank into the nip of drive wheels 504 for passage past the glue gun 492 so that appropriate beads of glue can be delivered onto the upper surface of the body blank. Drive assembly 490, in turn, delivers the blank into the flap folding station 494 against the stop means 496 by means of shuttle 493. After the flaps have been formed and laminated in the desired configuration, upon a second actuation of the shuttle means 493 and retraction of the stop means 496, the partially formed blank is delivered into the nip of inner drive wheel assembly 498 to be passed into the mainframe 452, where it is arrested by the stop means 464. Thereupon, the formation of the box is completed in a conventional manner by the mandrel and die means 48', 50'.

Figure 50:
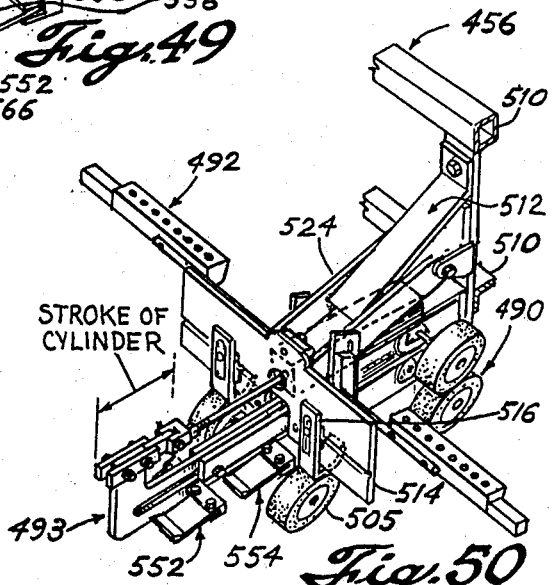
FIG. 50 is a partial perspective view of the shuttle mechanism of FIGS. 45–47, on a larger scale.

Referring now to FIG. 50, the uppermost portion of the outer feed frame 456 includes a vertically spaced apart pair of horizontally extending transverse frame members 510 to which a cantilever framework 512 is secured. The frame 512 is located parallel to and extending downstream along the common longitudinal centerline of inner and outer frames 454, 456, in superposition to the outer drive wheel assembly 490. At its inner end the cantilever frame 512 terminates in a transversely extending plate 514 that has a pair of pressure shoes 516 mounted on opposite sides of the shuttle mechanism 493, each shoe being mounted in opposition to an inner wheel 505 of the drive wheel assembly 490. The glue gun assembly 492 is mounted in the gap between inner and outer drive wheels 505, 504 whereby appropriate beads of glue are deposited on the upper surface of the blank E" as it passes thereby.

The shuttle mechanism 493 includes a pneumatic cylinder 520 internally mounting a piston driven piston rod 522 extending through an inner end of the cylinder housing. The inner end of the cylinder housing mounts a yoke plate 524 by means of which the cylinder is secured in place on the cantilever frame 512, as shown in FIG. 50. The downwardly extending arms of the yoke plate 524 fixedly support a parallel pair of horizontally extending guide bars 526 in parallelism to the piston rod 522.

The shuttle mechanism includes a shuttle bar 528 formed with an aligned pair of longitudintally spaced apart elongate outer and inner slots 530, 532, respectively. The pair of guide bars 526 are formed at each end with aligned through bases to receive a fastener means 534 therethrough and through a bearing 536 having rolling contact with one or the other of the slots 530, 532. The piston rod 522 terminates in a yoke 540, the spaced arms of which are formed with slots 542 in registration with one another. An upstanding lobe 544 is integrally formed at the inner end of the shuttle bar 528 to be received between the arms of the yoke 540 whereby appropriate fasteners 546 extending through the slots 542 and perforations formed in the upper edge of the lobe 544 driveably secure the shuttle bar 528 to the piston rod 522.

As shown in FIGS. 45–47 and 49 a body blank support shoe 550 is affixed to the outer feed frame 456 to extend along the longitudental center line thereof in spaced parallel opposition to the shuttle bar 528. As is best seen in FIG. 50, the shuttle bar 528 is fitted with an inner pair of shuttle blades 552 and an outer pair of shuttle blades 554. Each of these is interconnected to the shuttle bar 528 in a manner best seen in FIG. 49.

Each blade comprises a stiff metal plate 556 which at its root is loosely secured by appropriate fasteners 558 within a slot formed in one edge of a mounting bar 560. The root end of bar 560 is secured, as by welding, to one side of the shuttle bar 528. The slot in the edge of the mounting bar 560 is of sufficient width to permit relatively free oscillation of the plate 556 within a range as indicated by the directional arrow 561, the plate however being retained by means of the fasteners 558. The free end of the plate 556 is fitted with a weight member 562 of essentially triangular cross sectional configuration. Each blade 552 is thus gravitationally biased downwardly within the range of oscillation permitted by the slot of the mounting bar 560.

It will be observed that the weight member 562 terminates in a flat face positioned normal to the stroke of the shuttle bar 528 and is thus adapted for driving engagement along its length with the trailing edge of a body blank being worked on. Preferably, a notch 564 is cut into a lower inner corner of the memer 562 whereby the lower edge of the blade 552 may descend beneath the plane of the upper surface of the support shoe 550. In some cases, it may be desired to add a leaf spring 566 in a position to be biased downwardly onto the top face of the blade 52 to avoid a bouncing action of the shuttle blade. Such optional leaf spring may be secured in place by a fastener 568 through one end thereof into the corresponding mounting bar 560.

Figure 45:
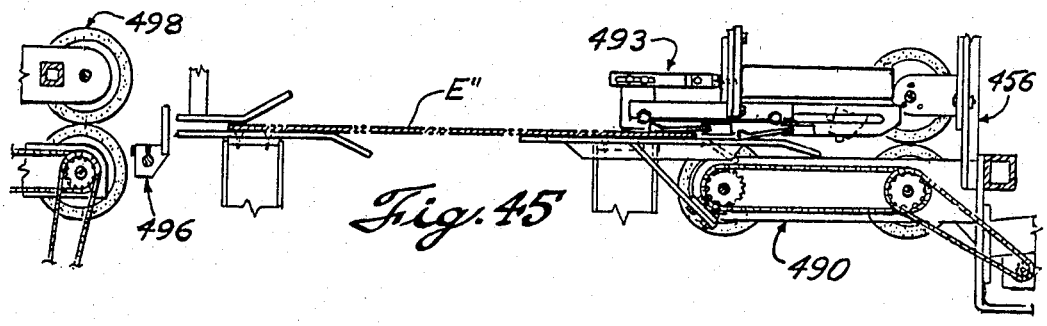
FIGS. 45–47 are longitudinal sectional views, approximately corresponding to FIG. 42, which show an improved shuttle mechanism and the parts thereof in different operative relationships to one another.
Figure 46:
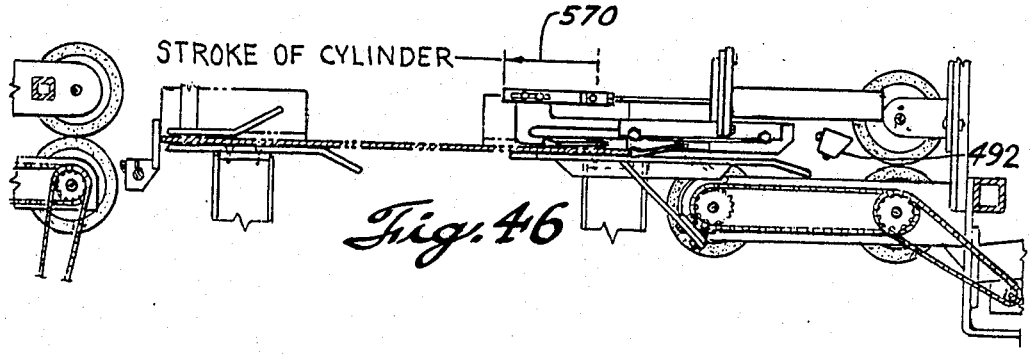
Figure 47:
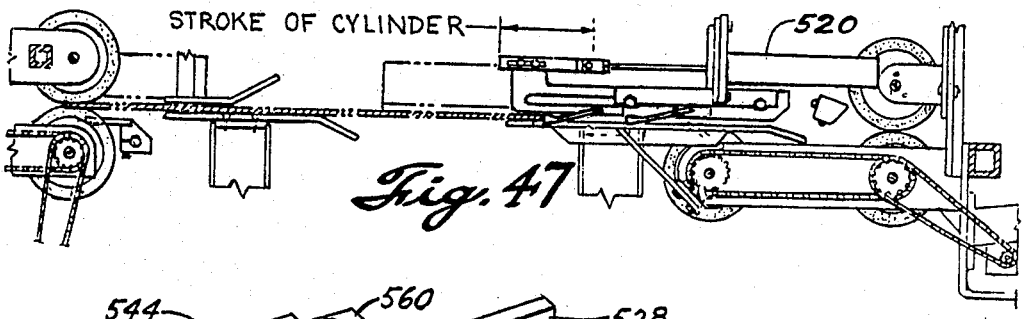
Figure 49:
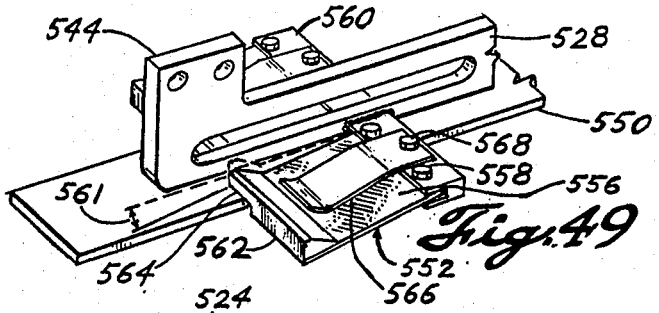
FIG. 49 is a partial perspective view of one of the pairs of shuttle blades of the shuttle mechanism and, particularly, of the area enclosed at 49 in FIG. 48.
Figure 48:
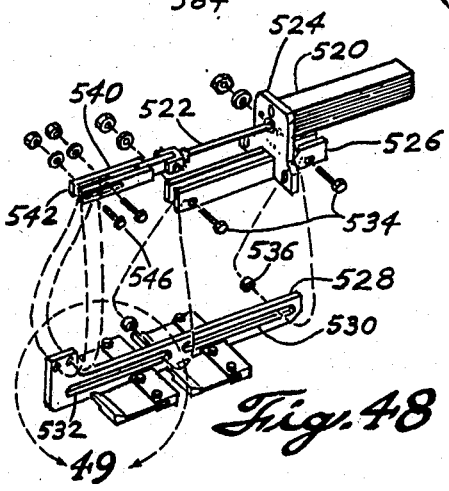
FIG. 48 is an exploded perspective view of portions of the shuttle mechanism of FIGS. 45–47.

The manner of operation of the outer frame drive mechanism 490, 493 and its coaction with stop means 496 is best seen in the sequence of FIGS. 45–47. Referring first to FIG. 45, an exemplary body blank E" is represented as having been transported inwardly just beyond the range of the drive wheel mechanism 490. Because of the frictional drag imposed by the edge guides and support shoes for the flat blank it frequently comes to a halt in the position shown, out of contact with the then upstanding stop means 496. In other situations, the body blank may have been driven against the stop means but then rebounded. In any case, however, the pneumatic cylinder 520 is actuated to extend through its full stroke indicated at 570 in FIG. 46. As a result, the pair of rear shuttle blades 552 have come into engagement with the trailing rear edge of the body blank which halts, in a desired position indexed relative to the flap folding and laminating mechanism, against the stop 496. The inner pair of shuttle blades 552 have been deflected upwardly and rest on the top surface of the body blank.

At this point, the pneumatic cylinder 520 remains energized in a condition to keep its piston rod 522 fully extended. As a result, the body blank E" is held in an accurately indexed position while the flap folding and laminating mechanism 494 goes through a cycle to form the four corner flaps of the body blank into a desired post configuration. Upon completion of the flap folding operation, the pneumatic cylinder 520 goes through a cycle of retraction and extension. As a consequence; upon the retraction stroke the outer shuttle blade 552 is withdrawn from the trailing edge of the body blank; upon full retraction of the piston rod, the inner pair of shuttle blades 552 drop into engagement with the trailing edge of the body blank; and upon subsequent extension of the piston rod the inner shuttle blades 552 propel the body blank into the nip of the inner drive wheel assembly 498. The inner drive wheels thereupon drive the partially formed blank into properly indexed position into the main frame 452, as aforesaid.

Figure 53:
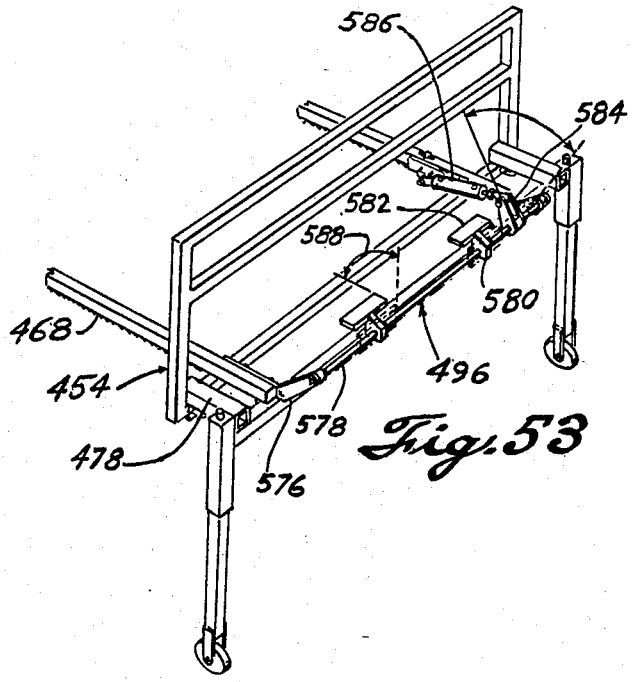
FIG. 53 is a partial perspective view of a stop frame assembly of the machine of FIG. 35.

The retractable stop means 496 is best seen FIG. 53. As shown, the stop means is preferably incorporated into the inner feed frame 454, connected to the outer ends of the horizontally extending frame members bearing the racks 468 on their undersides. Thus, each of these frame members mounts an outwardly projecting bracket 576 that rotatably supports one end of a shaft 578 extending therebetween. A pair of lugs 580 are mounted on the shaft 578 to project radially outwardly from the shaft in such a fashion as to be co-rotatable with the shaft. The radially outer end of each of the lug members 580 terminates in a flat stop plate 582. The pair of stop plates 582 are equally spaced on opposite sides of the longitudinal centerline of the frame 454. Adjacent one end the shaft 578 is fitted with a bell crank 584 whose outer end is pivotally connected to the piston rod of a pneumatic cylinder mechanism 586 having its other end pivotally connected to one of the side frame members 468. The arrangement is such that when the pneumatic cylinder 586 has its piston rod retracted in the solid outline position shown, the stop plates 582 are also in a retracted position with their top faces horizontally disposed in a common plane. Upon actuation of the pneumatic cylinder 586 to turn the shaft 578 the stop plates 582 are correspondingly turned through essentially a 90° arc as indicated at 588, after which the stop plates 582 are disposed in vertically extending position, as shown in FIG. 51, to arrest the leading edge of a body blank transported thereagainst.

Figure 51:
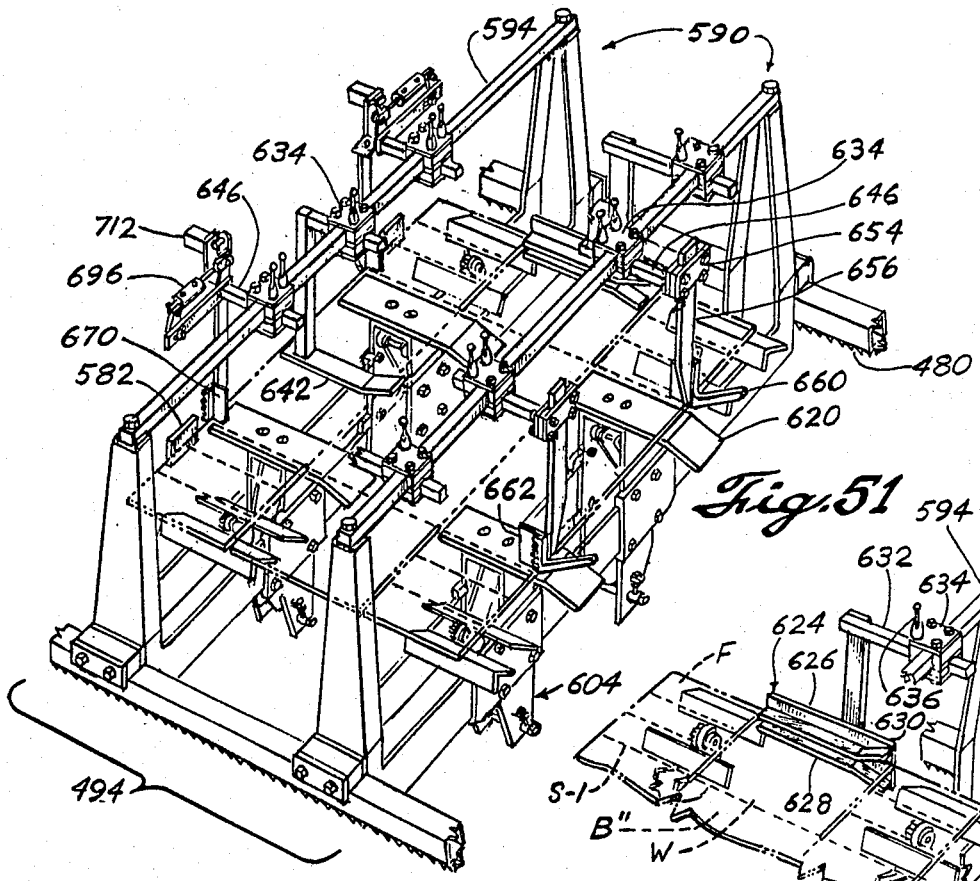
FIG. 51 is a partial perspective view of a portion of the folding and laminating station of the machine of FIG. 35, portions being broken away or deleted for the sake of clarity of illustration of other parts.
Figure 58:
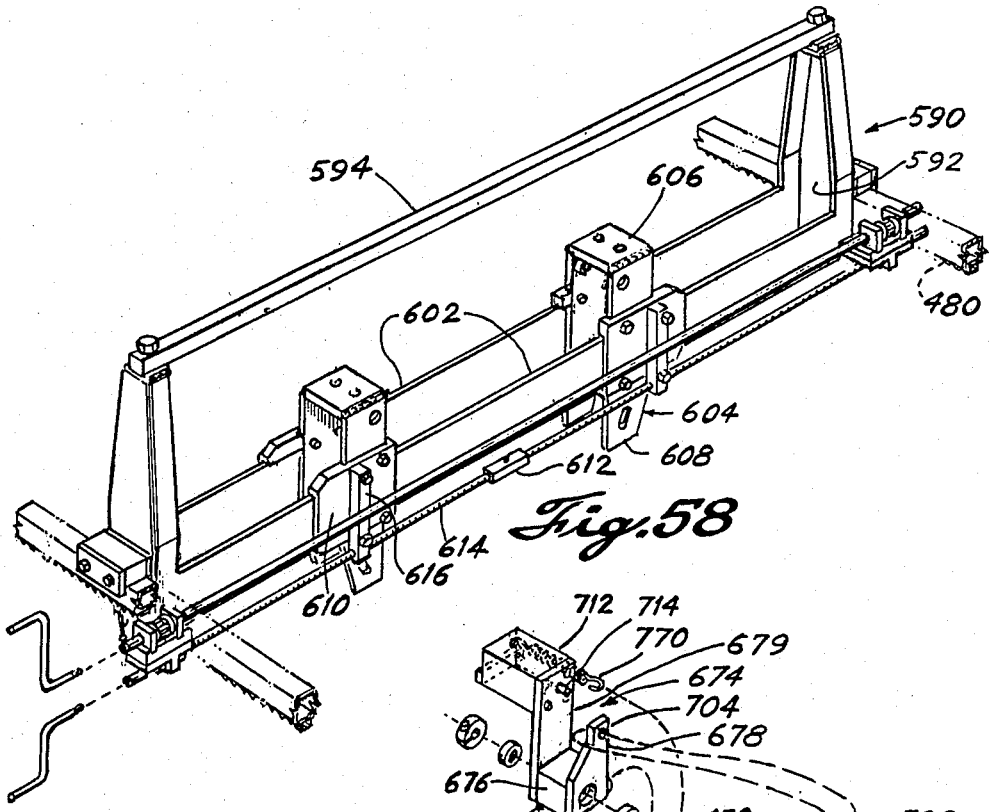
FIG. 58 is a partial perspective view of a carriage frame mechanism for mounting a pair of the trunnion mechanisms.

Referring to FIG. 51 the flap folding and laminating mechanism 494 comprises a pair of bridge assemblies 590. As these are essentially the same, but one of them will be described, with reference to FIG. 58. Each assembly at its opposite ends is defined by one of a pair of vertical channel members 592 having upstanding tapered sections whose upper ends are rigidly secured together by a bridging rod 594. Each channel member 592 on its outer face is fitted with a slide block 596 that slidably bears against the top surface of one of the horizontal frame members 480. Each slider block is fitted on its outside with a clamping plate 598 which can be tightened down by means of appropriate fasteners, to bear against the outside face of the corresponding frame member 480. Referring again to FIG. 51, it will be appreciated that the spacing between the pair of bridge assemblies 590 is dictated by the size of the blank being worked on. Accordingly, it will be understood that the pair of bridge assemblies are moved to adjusted positions relative to one another, by means of a crank operated pair of coaxially mounted pinions 600 engaged with rack members 480, after which the clamping plates 598 are tightened. The several components supported by the pair of bridge assemblies will be thus indexed in properly spaced apart operative positions relative to the blank.

Referring again to FIG. 58, each bridge assembly also includes a spaced pair of plates 602 bridging the space between lower ends of the pair of channel members 592. As shown, the plates 602 are vertically disposed in parallelism to define a clear space therebetween. In each bridge assembly 590, the pair of plates 602 support a pair of carriages 604. The upper edges of the pair of plates 602 serve as ways upon which the pair of carriages 604 are slideably adjustable relative to one another.

Figure 64:
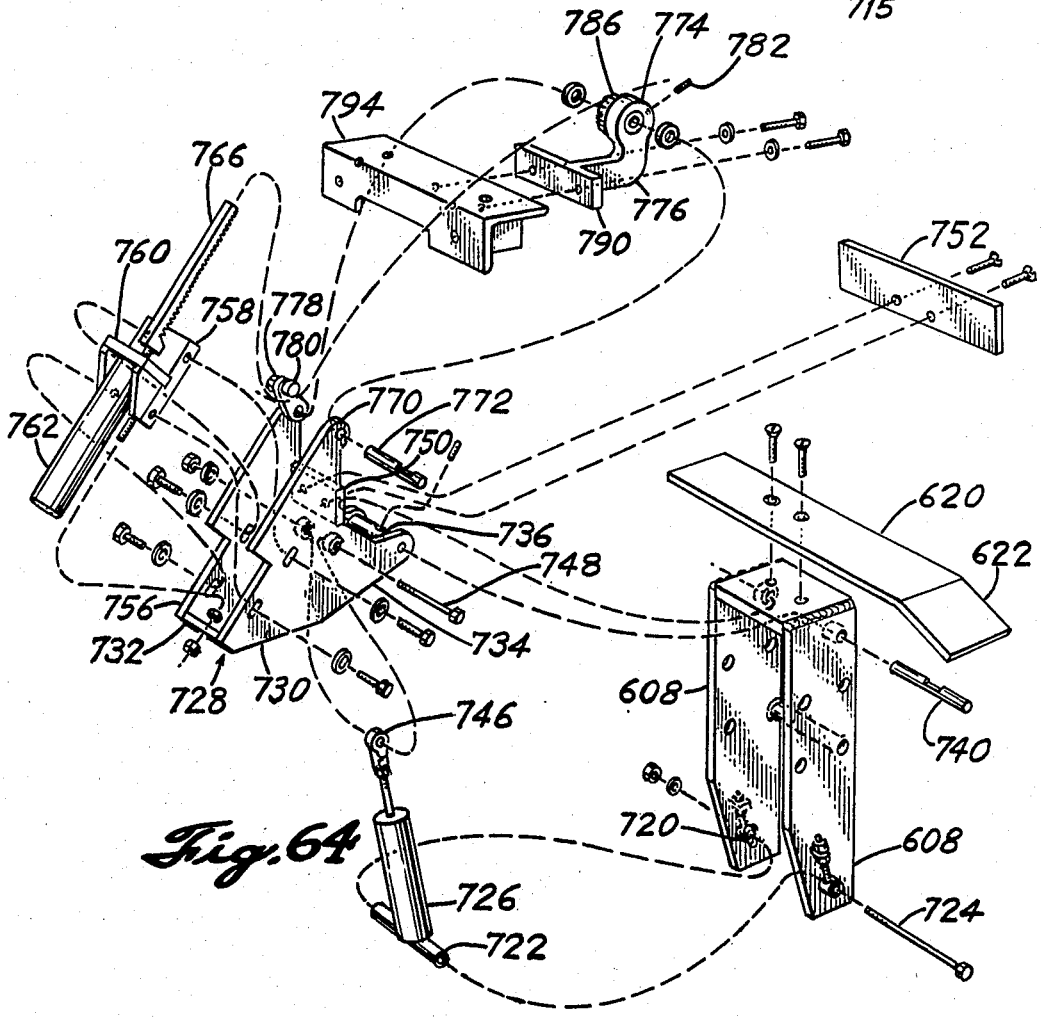
FIG. 64 is an exploded perspective view of the components of the mechanism shown in FIG. 63.

Each of the carriages 604 is of essentially inverted U shaped configuration comprising a horizontal web portion 606 from opposite sides of which a pair of legs 608 extend downwardly (See FIG. 64). Each of the legs 608 is fitted with a carriage clamp 610 adapted to slidably embrace or clamp against the opposite edges of the corresponding member 602. One of the members 602 is fitted on one face with a block 612 that holds the center of a horizontal shaft 614 against axial displacement while supporting it for rotation. Portions of the shaft 614 on opposite sides of the block 612 have threaded engagement with members 616 secured to the carriage clamps 612, the two halves of the shaft being threaded in opposite directions. It will be apparent that upon appropriate rotation of the shaft 614 in one direction or the other, if clamps 612 have been loosened, the pair of carriages 604 can be adjusted relative to one another as desired.

Figure 54:
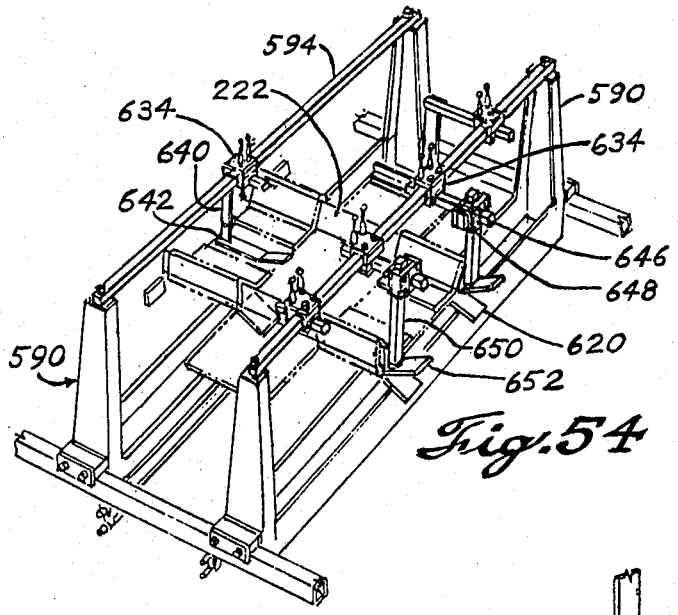
FIG. 54 is a partial perspective view of a portion of the mechanism shown in FIG. 51 but adapted for the manufature of tray style boxes with triangular corner posts.
Figure 67:
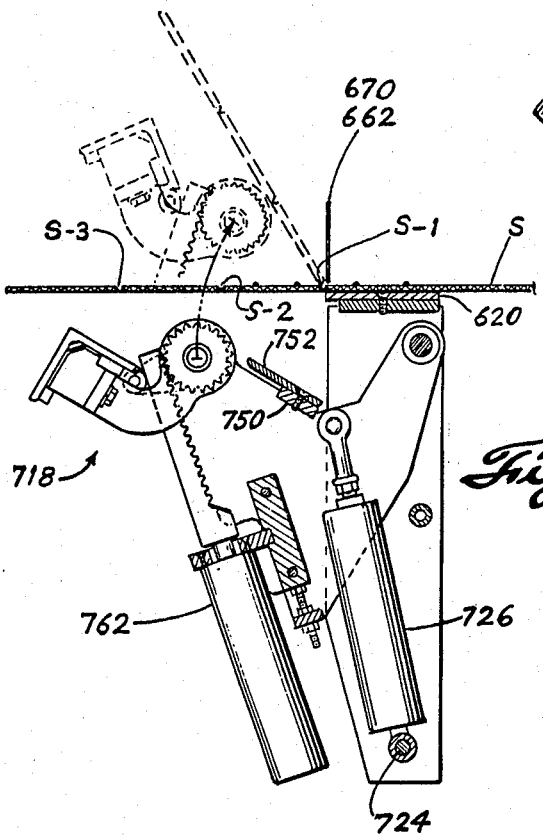
FIGS. 67–69 are partial vertical sectional views illustrating different positions of parts of the platen mechanism during a cycle of operation.

As seen in FIG. 64, each of the carriage assemblies 604 is fitted at its upper end with a body blank support shoe 620 secured by a suitable fastening means to the web 606. As is best seen in FIGS. 51 and 54, the support shoes 620 of all four carriage assemblies 604 are oriented parallel to the direction of the flow of the body blanks through the machine and each has an upstream end 622 that slopes downwardly to ensure that the leading edge of a body blank sliding thereon is guided onto the common plane of the four support shoes. As shown in FIG. 67, the lateral adjustment of the carriage assemblies is such that a sidemost edge of of each support shoe 620 is in alignment with the foldline S-1 defining the junction between a flap F and sidewall S of the exemplary body blank shown in FIG. 43.

Figure 52:
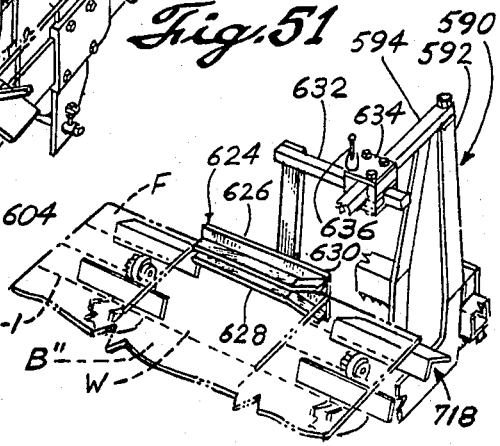
FIG. 52 is a partial perspective view of the mechanism of FIG. 51 showing an edge guide mechanism.

As shown in FIG. 43, when the body blank E" enters into and comes to rest in the flap folding and laminating station 494 its opposite side edges are supported in an opposed pair of edge guides 624. Thus, as is seen in FIG. 52, each edge guide 624 comprises a longitudinally extending vertically disposed rectangular plate 626 whose inside surface supports a vertically spaced apart horizontally extending pair of straps 628 whose upstream ends are divergently flared, as at 630, to receive the leading edge of an entering body blank. Each edge guide 624 is suspended in place in the correct orientation by means of a hanger bracket 632 of inverted L-shape configuration that is suspended from the cross rod 594 of one of the bridge assemblies 590 by means of a clamping block or saddle 634. The clamping saddle 634 is of a type which upon actuation of a handle 636 can be loosened in order to permit adjustment of the entire assembly laterally with respect to the support rod 594.

As is shown in FIGS. 51 and 54, another clamping bracket 634 is mounted on the cross bar 594 of the downstream one of the bridge assemblies 590. In this case the bracket supports a downwardly depending support rod 640 from whose lower end a hold down shoe 642 extends horizontally upstream, the upstream end of the shoe having an upwardly sloped portion. It will be appreciated that the bottom surface of the hold down shoe is disposed in a plane substantially flush with the upper surface of a body blank passing through the machine. The shoe is disposed at the midpoint of the cross rod 594 so that it bears on the midline of the side wall flap S of the body blank E", as shown in FIG. 43.

Figure 70:
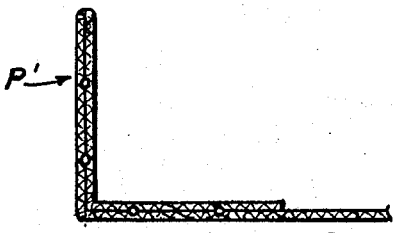
FIG. 70 is a transverse sectional view of a fully laminated corner post of a tray style box as formed by the trunnion mechanism of FIGS. 67–69.

The dual bridge assembly of FIG. 54 can be adapted to support mandrels for the making of triangular corner posts in the box walls, much in the manner of FIG. 32 or, alternatively to support finger mandrels for making fully laminated right angle corner posts P' as shown in FIG. 70.

In the former case, referring to FIG. 54, the upstream bridge 590 mounts another spaced pair of saddle clamps 634 on its cross rod 594. Each of the clamps has an upstream projecting horizontally disposed bar 646 bearing a clamp 648 that, in turn, suppots a downwardly projecting rod 650. The lower end of each of the rods 650 is fitted with a downstream projecting triangularly shaped mandrel 222, like that of FIG. 32. On its upstream side the lower end of each support rod 650 is fitted with an upwardly flared deflection shoe 652 to guide the upper surface of the body blank into the plane of the lower face of the corresponding mandrel 222. It will, of course, be understood that each mandrel 222 is supported in vertically spaced opposition to and overlies a corresponding shoe 620.

In the latter case, an alternative arrangement, for supporting a set of finger mandrels, is shown in FIG. 51. In this case, the upstream bridge assembly 590 is again fitted with a pair of the saddle clamps 634 horizontal rod 646. However, in lieu of the clamp 648 of FIG. 54, the upstream end of each rod 646 is fitted with a clamp 654 to rigidly support a downwardly extending strap 656. In its lower portion, each strap member 656 on its inside edge tapers towards the straight vertical outer edge of the strap to terminate in an apex. On the upstream face of each strap member 656, a member 660 is mounted to slope upwardly upstream to act as a guide in the manner of the guide 652 of FIG. 54. Each strap member 656, along its outer edge and at its apex portion, has rigidly secured thereto a fixed mandrel finger 662 fixed to the downstream side of the strap 656.

As is best seen in FIG. 67, the fixed finger mandrels 662 are oriented to overlie the outer edge of a support shoe 620 at its upstream end and the space between the lower edge of the finger 662 and the upper surface of the shoe 620 defines a gap designed to permit passage of the body blank material therebetween. It should also be understood that the vertical dimension of the finger 662 is such as to be matingly receivable, to a depth of about one inch in the folded flap material between the scorelines S-1 and S-2. The finger 662 is made of an essentially rigid stiff material, but is sufficiently thin, e.g., about one thirty-second of an inch that the first and second portions of the flap F between scorelines S-1 to S-3 can be wrapped therearound without any significant or appreciable permanent deformation of the paper skin as a result thereof.

Figure 59:
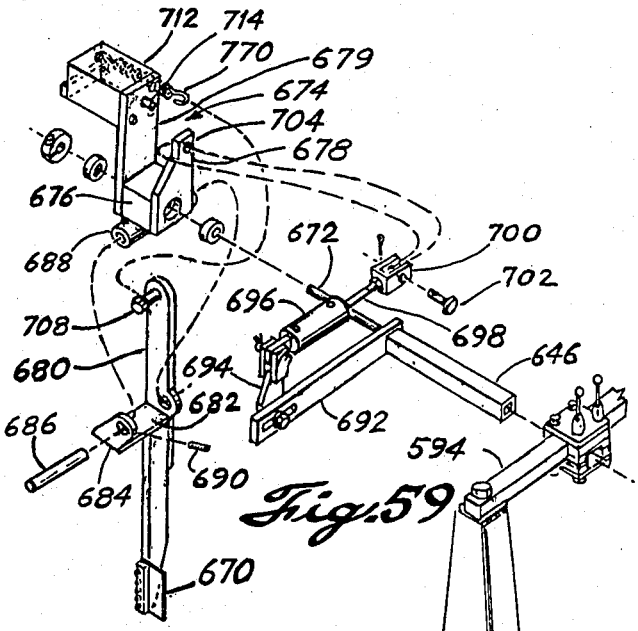
FIG. 59 is a partial exploded perspective view of portions of a mandrel finger mounting mechanism.
Figure 60:
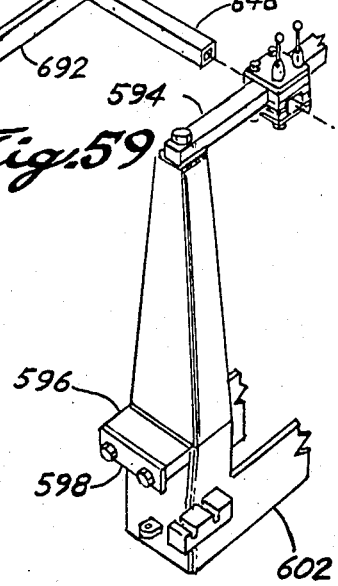
FIG. 60 is a partial elevational view, taken on the line 60—60 of FIG. 61, of the mandrel finger mounting mechanism.
Figure 60:
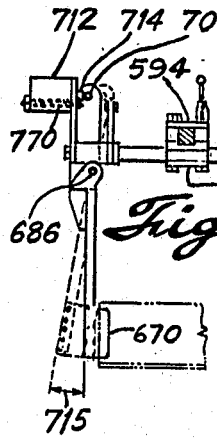
Figure 61:
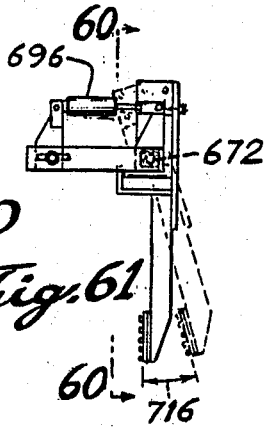
FIG. 61 is a partial elevational view of the mechanism shown in FIG. 60, rotated through 90°.
Figure 63:
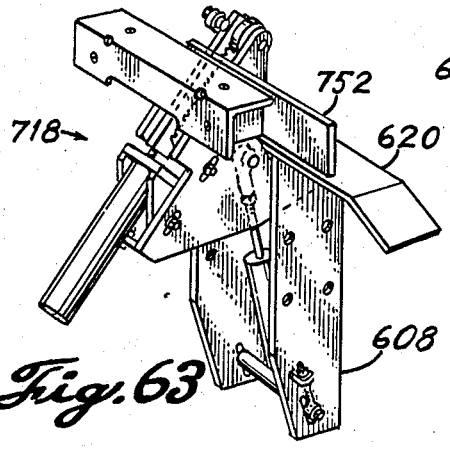
FIG. 63 is perspective view of a flap folding trunnion assembly.

The downstream bridge assembly 590 is likewise fitted with a pair of the saddle clamps 634 to each mount a horizontally downstream projecting rod 646. However, in this case, the downstream end of each rod 646 carries an assembly, best seen in FIGS. 59–61, to mount a pair of downstream mandrel fingers 670 for oscillation on two axes that are orthogonally related to one another.

The downstream end of the bar 646 has a coaxially projecting pivot shaft 672. A generally J shaped rocker bracket 674 is defined by a rigid assembly of a base block 676, short leg 678 and long leg 680. The base ends of these three members are formed with a through bore adapted to be rotatably journalled on the pivot shaft 672.

The mandrel finger 670 (sized like finger 662) is secured to the lower end of a vertically disposed rocker arm 680. In a medial portion of the arm 680, projecting normally to the plane of the finger 670, is an integral flange member 682 terminating in a lobe 684 disposed in registration with a similar lobe formed in the arm 680. The pair of lobes are formed with coaxial bores adapted to receive a pivot shaft 686 that is, in turn, journalled through a tubular sleeve 688 affixed to the bottom of the block 676. A set screw 690 is mounted in a tapped bore extending radially through the lobe 684 to engage the pivot shaft 686 in order to key the arm 680 to the shaft for corotation therewith.

As will now be apparent, the mandrel finger 670 is swingable about two mutually perpendicular horizontal axes defined by the shafts 672, 686. In order to effect oscillation of the mechanism about the axis 672, the rear end of the support bar 646 rigidly mounts a sidewardly outwardly projecting bar 692 whose outer end adjustably mounts a bracket 694. The latter in turn, pivotally mounts one end of a bi-direction pneumatic cylinder 696 parallel to and above the bar 692. A piston rod 698 of the cylinder 696 terminates in a yoke 700 that is pivotally secured, by an appropriate fastener means 702, or through a perforation 704 formed in the upper end of the short leg 678 of the rocker assembly 674. Accordingly, extension and retraction of the piston rod 698 effects rocking of the assembly 674 on the pivot shaft 672 with consequent rocking of the mandrel finger support arm 680 through the arc 716 of FIG. 61.

The upper end of the arm 680 is fitted on one side with a stud 708 to which one end of a tension spring 710 is connected. The opposite end of the spring is connected to a uni-directionally acting pneumatic cylinder 712 secured to the downstream facing side of the long leg 680 of the assembly 674. Thus, when piston rod 698 is retracted, the spring 710 normally maintains the mandrel finger 670 in the position indicated in solid outline in FIG. 60, in readiness to have a flap of the box material wrapped therearound. The cylinder 712 has an outwardly projecting piston powered rod 714 against which the stud 708 of the arm 680 is normally biased by the spring 710 in the solid outline position of FIG. 60. Upon actuation of the cylinder 712 in a mode to extend the rod 714, the arm 680 is swung about the axis of the pivot shaft 686 through the amplitude indicated at 715 in Fig. 60.

Movement of the swingable mandrel fingers 670 is controlled by the circuit schematically shown in FIG.

62, wherein the solid outline position of the finger corresponds to its position in FIG. 51. As will be apparent from the latter figure, the necessary sequence is to first swing both fingers downstream through arc 715 to a retracted position and then, while the fingers are held retracted, to swing them laterally outwardly through arc 716. Both fingers now being out of interfering alignment with the posts just formed, and stops 582 being retracted, the partially formed workpiece can be advanced downstream. As is shown in FIG. 62, this sequencing of the mandrel fingers 670 is controlled by a single valve.

Figure 62:
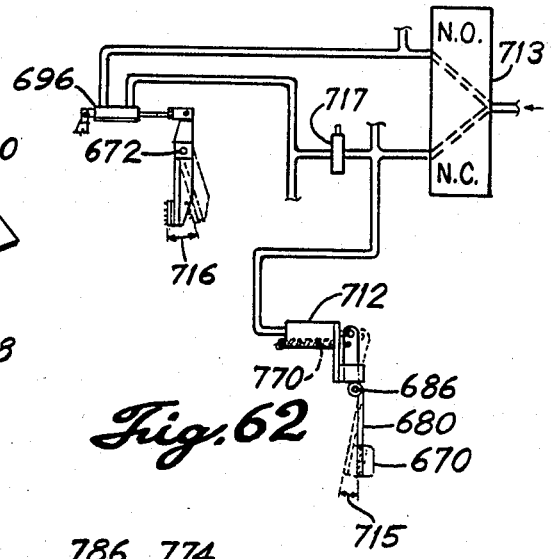
FIG. 62 is a schematic diagram of a control circuit for controlling actuation of a mandrel finger.

Referring to FIG. 62, the unidirectionally acting cylinder 712 has its pressureizable side connected to a normally closed port of a valve 713, while one side of the piston of the cylinder 696 is in communication with a normally open port of the valve 713. The corresponding finger 670 accordingly is maintained in the position shown in FIG. 51. After a right angle corner post P' has been formed in the sequence of the steps shown in FIGS. 67–69, the valve 713 is actuated to open its normally closed port and to close the normally open port. As a result, the unidirectionally acting cylinder 712 is actuated to overcome the spring 770, thus swinging the fingers 670 out from between the overlapped first and second sections of the flap. After the the finger has thus been swung in a downstream direction, a flow control 717 opens to communicate the other side of the piston in the cylinder 696 with the source of compressed air. The opposite side of the piston being now open to atmosphere, the piston rod 698 is displaced in a direction to swing the finger 670 laterally outwardly through the arc 716. Coincidentally, the stops 582 are retracted whereby to permit movement of the partially formed tray body blank in to the mainframe 452. The valve 713 then being actuated to return to its normal condition, the finger 670 is thus permitted to return to its position in readiness for the next body blank.

Details of the flap folding mechanisms 718 are best seen FIGS. 63–69. This mechanism is greatly improved and simplified as contrasted to the flap folding mechanism 244 of FIG. 21. However, the improved mechanism is limited to the making of corner posts while the FIG. 21 mechanism as shown in FIG. 22 is adaptable to a combination of corner and intermediate posts.

Figure 44:
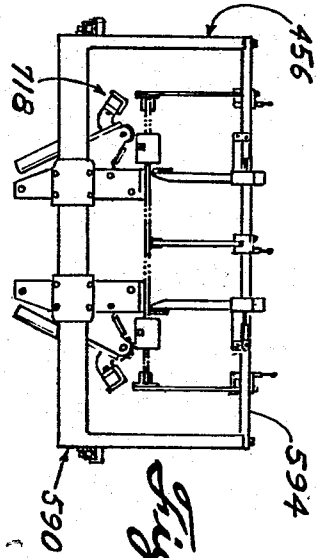
FIG. 44 is a vertical sectional view taken on the line 44—44 of FIG. 42.

As indicated in FIGS. 42–44, a folding mechanism 718 is disposed in the flap folding and laminating station 494 at each of the corner flaps F of a box blank E''. As the four mechanisms are essentially identical, but one will be described.

Each of the mechanisms 718 comprises a part of a carriage assembly 604. Thus, the pair of the vertical members 608 at their lower ends are formed with a pair of through bores 720 in coaxial alignment with a tubular sleeve 722. A suitable fastener means 724 extends through the coaxially aligned members whereby to pivotally mount the lower end of a pneumatic cylinder 726 fastened to the top side of the sleeve 722.

A trunnion 728 is defined by a spaced apart pair of irregularly shaped plates 730 rigidly held together in spaced relationship by a web member 732. The pair of plates 730 have lobe portions 734 spanned by a rigidly affixed sleeve 736 adapted to be rotatably mounted on a shaft 740 secured between the upper ends of the side members 608, just beneath the web 606 of the carriage. As indicated in the drawings, the trunnion assembly is receivable in the clear span between the pair of vertical legs 608 so as to be pivotably swingable between the extremes shown in FIGS. 67 and 69. To effect this arcuate movement, the pneumatic cylinder 726 is fitted with a piston rod 742 that terminates in a yoke 746 rotatably coupled to the trunnion 728 by appropriate fastener means 748.

Figure 68:
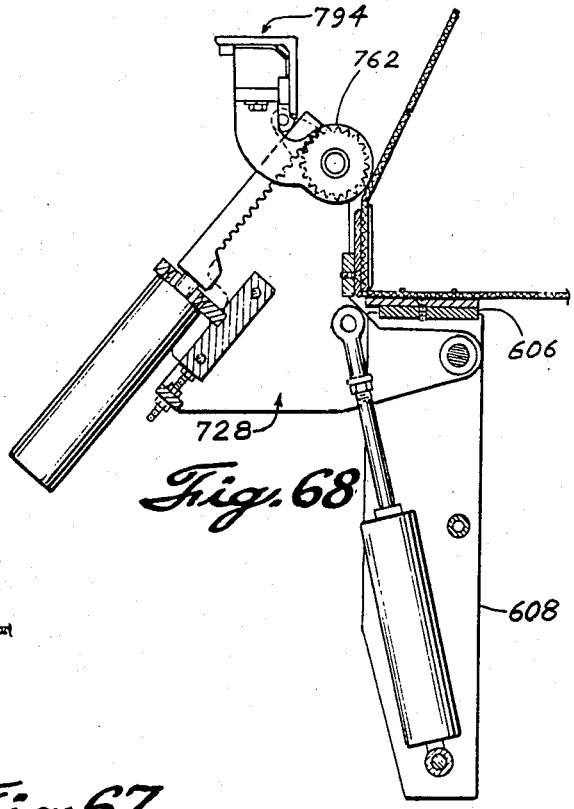

The similar trunnion plates 730 along one side have irregularly shaped or scallopped edges adapted to clear various parts of the adjacent machine as the trunnion is swung between its two extreme positions. These edges, however, include straight portions to which a bridge plate 750 can be secured and which, in turn, provides a foundation to which a rectangular pressure plate 752 is fastened. The pressure plate 752 is approximately of a length and width approximating the first flap portion between the scorelines S-1 and S-2. As is shown by FIGS. 67 and 68, a full extension of the piston rod of the cylinder 726 swings a pressure plate 752 through an arc of approximately 45–50°. As is apparent from the same figures, assuming that a set of mandrel fingers 662, 670 is in place or, alternatively, a triangular mandrel 222, the pressure plate 752 fuctions to fold the flap F about the scoreline S-1 through 90°. Thereafter, the pressure plate 752 remains in the vertically erect position of FIG. 68 and serves as a reactive surface against which further folding of the outer flap portions between the scorelines S-2 and S-3 and the terminal outer edge of the flap occur.

The last of the essentially three sides of the trunnion plates 730 are formed with step edges defining shoulders 756 against which a cylinder mounting plate 758 can be secured. The base plate 758 integrally includes an upstanding flange 760 against the back side of which a pneumatic cylinder 762 is rigidly mounted. As is shown in FIG. 67, the flange 762 is formed with a central aperture to permit the free passage therethrough of a piston powered reciprocable piston rod 764 that, in turn, rigidly mounts a coaxially extending rack member 766.

The trunnion plates 730 also have coaxially perforated lobes 770 adapted to journal a shaft 772 therebetween. This shaft 772, in turn, coaxially pivotally mounts a bearing portion 774 of the radially inner end of a bell crank member 776 and a bearing end of a radial arm 778. The latter is fitted at its radially outer end with a hold down roller 780 positioned to bear on the flat side of the rack member 766. The inner or bearing end of the crank member 776 is provided with tee set screw means 782, or the like, adapted to lock onto a flat surface of the pivot shaft 772. The bell crank member 776 at its radially inner end is coaxially formed with an integral pinion 786 engaged by the teeth of the rack 766. Accordingly, extension and retraction of the rack 766 effects corresponding co-rotation of the bell crank 776.

Figure 55:
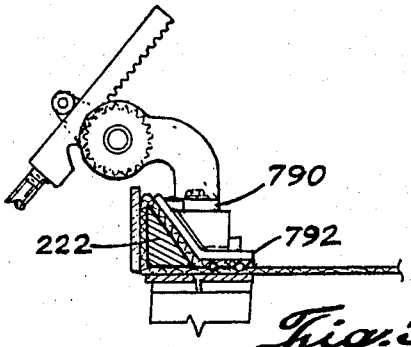
FIG. 55 is a partial vertical sectional view of a flap folding mechanism of FIG. 57 as adapted for making tray style boxes with triangular corner posts.
Figure 56:
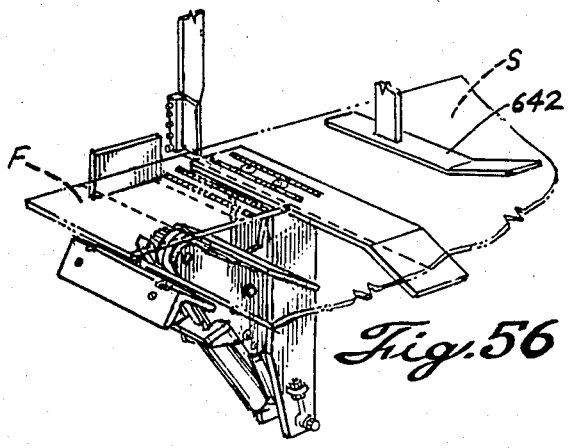
FIG. 56 is a partial perspective view of the mechanism of FIG. 55 in a retracted state, but with a different configuration of flap forming platen.
Figure 57:
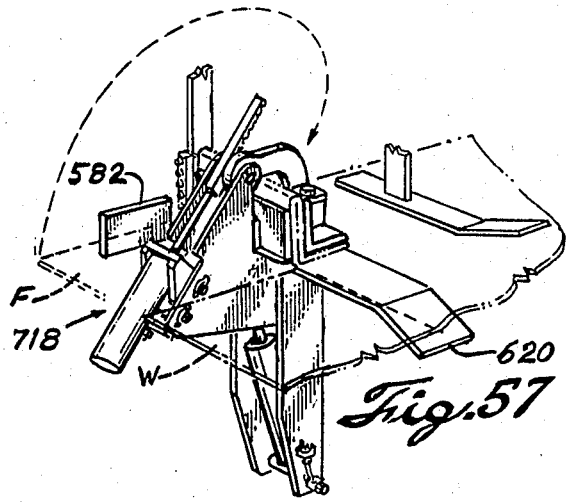
FIG. 57 is a partial perspective view showing the mechanism of FIG. 56 in an extended position.

The arm of bell crank 776 has an essentially 90° bend and its outer end terminates in a transverse mounting pad 790. This pad is adapted to carry either a rotary compression shoe or platen 792 shown in FIG. 55, such as is used in forming triangular corner posts, or a rotary compression shoe or platen 794 as shown in FIG. 66, adapted for the making of fully laminated right angular corner posts P' such as shown in FIG. 70.

Figure 65:
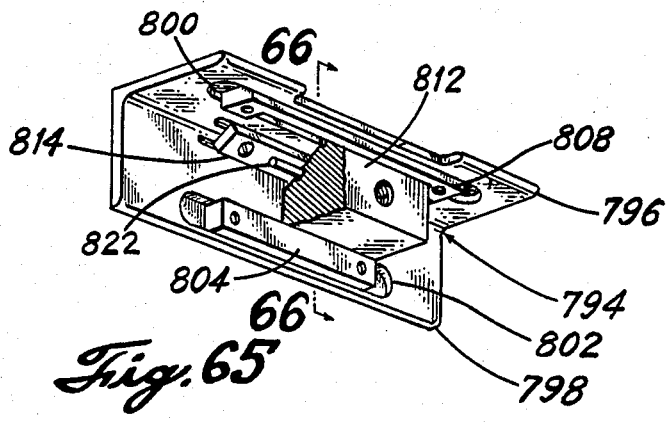
FIG. 65 is a perspective view, on a larger scale, of a platen or rotary compression shoe mechanism.
Figure 66:
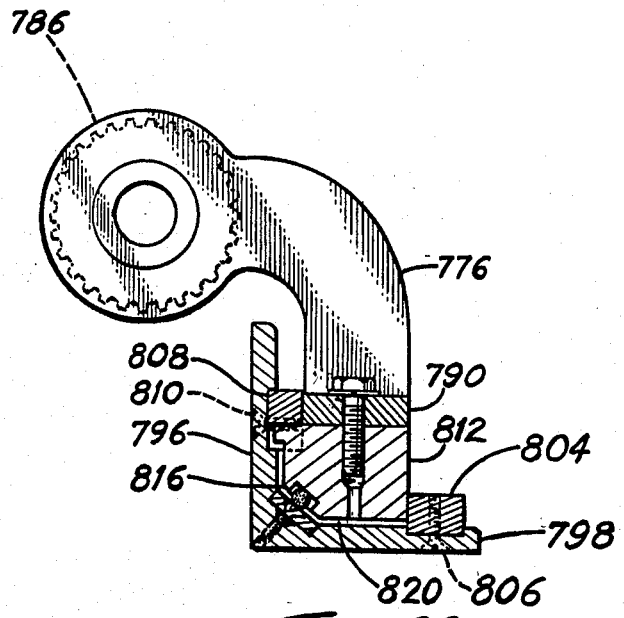
FIG. 66 is a sectional view of the platen mechanism of FIG. 65, taken on the line 66—66 of FIG. 65.
Figure 69:
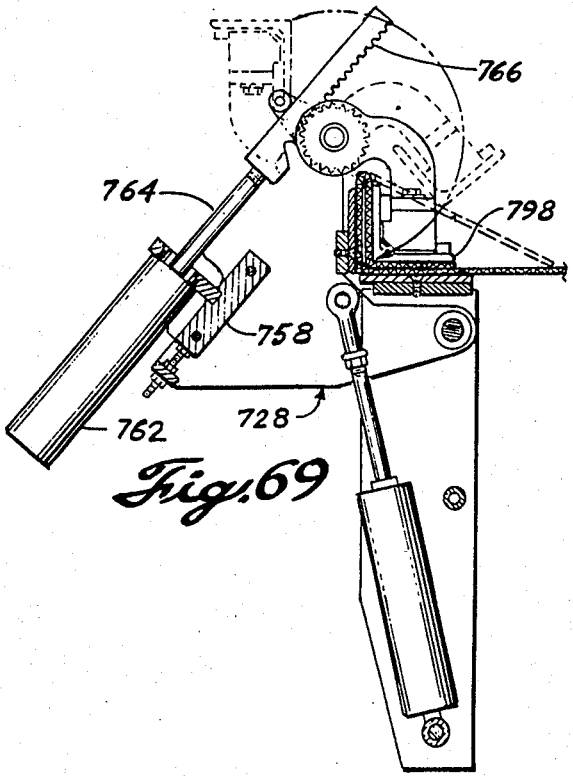

Referring to FIGS. 65 and 66, the compression shoe 794 comprises a length of angle iron, or the like, having flanges 796 and 798. As shown in FIG. 69, when the trunnion 728 has been fully extended the flange 796 works in opposition to the pressure plate 752 while the flange 798 works in opposition to the underplate lying support shoe 606. The flanges 796, 798 are each formed on its inner face with a longitudinally extending slot 800, 802, respectively, adjacent the lip of the corresponding flange. The slot 802 receives a clamp bar 804 held in place by fasteners 806 countersunk in the outer face of the flange 798, while the slot 800 mounts a clamp bar 808 held in place in a similar fashion by countersunk fasteners 810.

The bars 804, 808 are adapted to bear against right angularly related faces of a block 812 in a manner to permit limited relative displacement of the shoe 794 relative to the block 812, the block 812 in turn being securely attached by a fastener means 814 to the mounting pad 790 of the bell crank 776. As can be seen in FIG. 65, the clamp bar 808 is of a broad U-shaped in plan configuration so that its opposite ends confine the block 812 against longitudinal displacement while, at the same time, the bar 808 seats against the back side of the mounting bar 812. The other clamp bar 804 abuts against the other exposed face of mounting block 812.

At the internal corner of the compression shoe 794, the flanges 796, 798 are formed with longitudinally extending slots to seat opposite edges of an elongate, internal, bevel defining strap 814 that is secured in place by appropriate fasteners. The the apex of the mounting block 812 that confronts the strap 814 is formed with a complementary bevelled face 816. As is shown in FIG. 66, the inner face of the shoe 796 and the surfaces of the mounting shoe 812 in opposition thereto thus define a substantially uniform clearance gap 820 therebetween that permits a limited degree of opposed relative movement between the shoe 796 and the mounting block 812. The confronting faces of the strap 814 and bevel face 816 are each formed with opposed longitidinally extending grooves to seat a corresondingly elongate length of a rubber or other elastomeric material cylindrical cushion 822.

The arrangement just described permits the compression shoe 794 to undergo self aligning adjustment relative to the shoe 606 and pressure plate 752. As is indicated in FIG. 65, this manner of mounting accomodates a certain degree of misalignment of the long axis of the shoe 794 relative to the rotary axis of the crank arm 776. As will be apparent, merely by altering the configuration of certain of the mounting parts, the compression shoe 792 of FIG. 55, adapted for triangular corner posts, can be similarly mounted.

Referring to FIG. 67, it will be seen that as the cylinder 726 is actuated to extend its piston rod 764 through a full stroke, the other cylinder 762 and its associated mechanism, including pressure plate 752, are carried along with the trunnion 728 to the position shown in FIG. 68. Thereafter, upon actuation of the cylinder 762, the rack 76 rotates the pinion 762 to effect rotation of the rotary compression shoe 794 from the position of FIG. 68 to the position of FIG. 69. As a consequence, the second and third portions of the flap F are consecutively folded about the scorelines S-2 and S-3 and against the pressure plate 752 and shoe 620. Thereupon, the mandrel fingers 670 are swung out from sandwished relationship between the first two of flap portions and then sidewardly away out of interfering alignment with the tray blank by means of the circuit shown in FIG. 62. Upon the flap folding mechanism having been turned to a retracted position, the partially formed tray blank can now be advanced into the mainframe for completion of the tray container.

I claim:

1. A machine for forming a container out of any one of a wide range of sizes of flat blanks of a paperboard material, comprising:

a mainframe having coaxially aligned die means and mandrel means, both of which means are size adjustable, and further having a stop means that is adjustable relative to the common axis of said mandrel means and die means;

an inner feed frame;

means interconnecting said inner feed frame to said main frame for adjusting the position of said inner feed frame relative to said main frame while maintaining the longitudinal centerline of said inner feed frame in alignment with the axis of said mandrel means and die means;

an inner blank feed means affixed to said inner feed frame for conveying a blank through said inner feed frame and into said main frame;

said inner feed frame also having alternately extendable and retractable second stop means thereon in a position upstream of said inner blank feed means;

an outer feed frame;

means interconnecting said outer feed frame to said inner feed frame for adjusting the position of said outerfeed frame relative to said second stop means while maintaining the longitudinal centerline of said outer feed frame in alignment with the longitudinal centerline of said inner feed frame;

an outer blank feed means affixed to an upstream part of said outer feed frame for alternately conveying a blank into said outer feed frame to and against said extendable second stop means or out of said outer feed frame and into said inner feed frame upon retraction of said extended second stop means;

and a pair of mechanisms adjustably fixed to said outer feed frame to permit varying the spacing therebetween along the longitudinal centerline of said outer feed frame, said pair of mechanisms being means for performing an operation on a blank that has been arrested in said outer feed frame by said extended second stop means.

2. The machine of claim 1 in which:

said outer blank feed means comprises a shuttle mechanism having an inner blade and an outer blade that are reciprocated by said shuttle mechanism in upstream and downstream directions;

said outer blade being engageable with the trailing edge of a blank to convey the blank against said extended second stop means;

said inner blade being engageable with the trailing edge of a blank upon a second reciprocation of said shuttle mechanism to convey the blank past said retracted second stop means and into the upstream end of said inner blank feed means.

3. The machine of claim 2 in which:

said shuttle mechanism comprises means to bias a blank against said extended second stop means to define an indexed position of the blank relative to said pair of mechanisms of said outer feed frame.

4. The machine of claim 2 in which:

said outer blank feed means comprises an outer feed wheel assembly affixed to said outer feed frame upstream of said shuttle mechanism, said outer feed wheel assembly being adapted to advance the trailing edge of a blank downstream sufficiently to be disposed within the range of reciprocal movement of said outer blade of said shuttle mechanism.

5. The machine of claim 4 in which:

hopper means for containing a supply of blanks is mounted at the upstream end of said outer feed frame;

said hopper means having a downstream side that is in a fixed location relative to said outer blank feed means;

the other three sides of said hopper means being adjustable to contain any one of a wide range of sizes of flat blanks;

said hopper means also having a means that is adjustably fixed relative to said downstream side for stripping one blank at a time out of said hopper means and conveying it into the upstream end of said outer feed wheel assembly.

6. The machine of claim 1 in which:

said pair of mechanism adjustably fixed to said outer feed frame comprise flap folding mechanisms.

* * * * *